US010626524B2

(12) United States Patent
Cory et al.

(10) Patent No.: US 10,626,524 B2
(45) **Date of Patent: *Apr. 21, 2020**

(54) VORTEX TUBE BLENDER AND CONDITIONER

(71) Applicant: Lummus Corporation, Savannah, GA (US)

(72) Inventors: Mark David Cory, Bluffton, SC (US); Joseph W. Thomas, Richmond Hill, GA (US)

(73) Assignee: Lummus Corporation, Savannah, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/151,433

(22) Filed: Oct. 4, 2018

(65) Prior Publication Data

US 2019/0032251 A1 Jan. 31, 2019

Related U.S. Application Data

(63) Continuation-in-part of application No. 15/605,529, filed on May 25, 2017, now Pat. No. 10,156,398.

(60) Provisional application No. 62/341,406, filed on May 25, 2016.

(51) Int. Cl.

| | |
|---|---|
| ***D01G 13/00*** | (2006.01) |
| ***D01G 99/00*** | (2010.01) |
| ***D01G 23/08*** | (2006.01) |

(52) U.S. Cl.

CPC ..... *D01G 13/00* (2013.01); *D01G 23/08* (2013.01); *D01G 99/005* (2013.01); *D10B 2201/02* (2013.01)

(58) Field of Classification Search

CPC ..... F26B 3/10; F26B 17/02; F26B 17/102; F26B 17/107; B07B 7/086; D01G 13/00; D01G 23/08; D01G 99/005

USPC ..... 34/182

See application file for complete search history.

(56) References Cited

U.S. PATENT DOCUMENTS

| | | | | | |
|---|---|---|---|---|---|
| 2,724,686 | A * | 11/1955 | Nicholson | B01J 8/189 | 208/150 |
| 3,766,661 | A * | 10/1973 | Bayens | B04C 5/24 | 34/371 |
| 5,042,169 | A * | 8/1991 | Vero | B04C 5/20 | 34/591 |
| 5,533,276 | A * | 7/1996 | Vandergriff | F26B 17/101 | 34/583 |
| 5,915,814 | A * | 6/1999 | Crews | B04C 5/08 | 34/166 |
| 6,161,307 | A * | 12/2000 | Bourgeois | C25C 3/06 | 34/164 |
| 6,282,809 | B1 * | 9/2001 | Sunde | F26B 5/04 | 34/135 |

(Continued)

*Primary Examiner* — Stephen M Gravini

(74) *Attorney, Agent, or Firm* — Laurence P. Colton; Smith Tempel Blaha LLC

(57) ABSTRACT

A vortex tube system for conditioning and blending fibrous material utilizing a helical inlet to the base of a central vortex tube, to condition and blend fibers in a fluidly conveyed stream, and to separate the fibers from debris, by abruptly changing direction of the conveying air flow. The vortex tube system for conditioning and blending combines the helical input with helical shaping of the air flow through the central vortex tube to induce greater dynamics which is continued at the top of the vortex tube through a separate drying chamber.

22 Claims, 27 Drawing Sheets

(56) References Cited

U.S. PATENT DOCUMENTS

| | | | | |
|---|---|---|---|---|
| 6,715,705 | B2 * | 4/2004 | Rowley, Jr. | F26B 17/10 241/19 |
| 8,402,672 | B2 * | 3/2013 | Nielsen | F26B 3/12 110/224 |
| 10,156,398 | B2 * | 12/2018 | Cory | B08B 7/02 |
| 2003/0000186 | A1 * | 1/2003 | West | B01D 45/14 55/459.1 |
| 2017/0343283 | A1 * | 11/2017 | Cory | B08B 7/02 |
| 2019/0032251 | A1 * | 1/2019 | Cory | D01G 13/00 |

* cited by examiner

VORTEX TUBE BLENDER AND CONDITIONER

STATEMENT OF RELATED APPLICATIONS

This application is a continuation-in-part of U.S. patent application Ser. No. 15/605,529 having a filing date of 25 May 2017, which claims priority from U.S. Provisional Patent Application No. 62/341,406 having a filing date of 25 May 2016.

BACKGROUND OF THE INVENTION

Technical Field

The present invention is generally directed to a novel blending and conditioning system for fiber, or for other similar light-weight material, such as seed cotton. The present invention also is directed generally to a blending and conditioning system for optionally separating rocks, seeds, husks, plant matter or other heavy foreign matter out of the blending and conditioning process. The present invention is applicable to blending and conditioning processes for a singular stream (or lot) of material, or for combinations of two or more streams (or lots). In particular, the present invention also is directed generally to the construction of the unique features incorporated to achieve these objectives, while minimizing the energy losses traditionally associated with each.

Prior Art

The present invention is applicable to the seed cotton processing industry. After seed cotton is harvested, it is transported from the field to a cotton ginning facility. This type of facility has apparatus for receiving the seed cotton, drying and cleaning the seed cotton, removing the seeds from the cotton fiber or lint, cleaning the lint, and pressing the lint into bales for transport to warehousing, and later processing into yarn, thread, and fabric.

The qualities of each bale of cotton are measured and recorded through the testing of a small sample from each bale. These qualities are used as a means for determining the relative monetary value for each bale, and as a way for those who spin and weave cotton to sort out which bales are most suitable for a particular type of spinning process, and ultimately for which type of finished product each bale is best suited. Due to these considerations, it is desirable to homogenize quality variations between bales of cotton via blending prior to the spinning process, to more efficiently produce a highly consistent thread and fabric.

Historically, this blending takes place at the spinning mills where multiple bales of cotton are opened and a thin layer from each is removed and simultaneously processed. As qualities, like the fiber length, may vary dramatically from bale to bale, achieving a consistent mixture of bales at the beginning of the spinning process is quite challenging.

Further, the properties of each lot of seed cotton arriving at any one cotton ginning facility also may vary. Some of these variations can be attributed to the geographic location of the field from which they were harvested. Further considerations may include weather conditions before and after harvest, the type of harvesting method, local insect activity, irrigation techniques, fertilization, and competing weeds and other plants. Additional differences are realized due to seed cotton storage practices and cultivar.

It is important to note that seed cotton is usually conveyed pneumatically through much of the cotton ginning blending process, and that some systems include more than one stage of pneumatic conveyance for the blending portion of the process. Another point to consider is whether the conveying air is of a positive pressure, a negative pressure, or some combination of the two. A person having ordinary skill in the art understands that in some embodiments in the field a positive pressure system is understood as a push system, and a negative pressure system is understood as a pull system or pull-through system.

A person having ordinary skill in the art also understands that cotton can be processed more easily and safely at certain optimum levels of humidity or moisture content, and at optimum dynamics. More specifically, the exchange of moisture into or out of seed cotton is promoted when there is a relative movement between the seed cotton and a heated conveying air passing through the blending system.

Further, early in the cotton ginning process, a device known as a rock trap or rock catcher, which separates rocks, green cotton bolls, and heavy foreign material from the pneumatically conveyed seed cotton (see FIG. 1), is employed. This separation usually is achieved with a hopper-type rock trap 10 which operates by abruptly expanding the cross-sectional area of the negative-pressure conveying air stream and placing a deflector panel 11 in the direct path of the seed cotton and hot air stream. The deflector panel 11 directs the rocks and other heavy matter downward to an air-lock 12 and out of the system. Most of the seed cotton is light enough to be picked back up by the negative-pressure air stream as it passes around the deflector panel 11 and is then accelerated back into a path of similar cross-sectional area as was employed before the seed cotton entered the rock catcher. A relatively small amount of seed cotton does not get picked back up by the hot air stream and falls down toward the air-lock.

As is shown in FIG. 1, the prior art air-lock is commonly either of a rotary design 13, or as shown in FIGS. 2 and 5, of a double-door design 14, with one door separated by a small chamber over another door where only one door opens at a time. A person having ordinary skill in the art refers to such a rotary air lock structure as either a vacuum dropper or a vacuum wheel.

Further, in certain illustrative examples in the field, in an effort to minimize the amount of seed cotton lost in this process, an adjustable air inlet 15 is commonly employed, which allows ambient air to reclaim the seed cotton and send it upward away from the air-lock and back into the conveying air stream. Energy is lost in this process in multiple ways. First, the deflector panel creates a significant pressure drop, and second, the ambient air introduced to reclaim lost seed cotton dilutes the heat of the conveying air, thus reducing the drying capacity; and third, the energy required to pull in and accelerate this ambient air creates yet another pressure drop.

In the referred to prior art, in an effort to reduce the losses at the hopper-type rock trap 10, a system 16 (see FIG. 2) was successfully developed wherein a secondary hot air stream 17 is introduced immediately below the deflector panel 11, to keep the conveying air warm and introduce additional turbulence to enhance the drying process. This approach was applied in many installations and helped improve the system efficiency; however, the other losses described above remained. This approach also introduced the need for additional ductwork and complexity regarding air-balance, and introduced the opportunity for compromising the conveying air stream velocity by short-circuiting the pull-air through the secondary hot air stream inlet at the rock trap.

FIG. 3 shows another type of prior art rock trap catcher known generically as a conveyor-belt suction-duct-type 20 that can be employed at the point where the seed cotton initially enters the air stream. In one illustrative example, hot air is pulled into a plenum chamber integrated into the suction-duct. In a worst-case example, the cotton is picked up with ambient air much like a large vacuum cleaner and almost immediately dropped into an elevated feed hopper without the benefit of any heating at all, thus adding to the overall system energy requirements. Ambient air also is pulled into the system, thus diluting the hot conveying air in such a way as to be less efficient than the hopper-type rock traps.

While the number and type of components in drying systems vary from one facility to the next, some common prior art system components are shown in FIGS. 4 and 5. It is not uncommon for the device downstream of the rock trap to be either a shelf-type tower dryer 30, as taught by Bennett in U.S. Pat. No. 2,189,099, or some other type of large vessel 40, as taught by Jackson in U.S. Pat. No. 4,845,860, with either being designed to decrease the velocity of the seed cotton and allow slippage of the hot conveying air over and through the seed cotton. Often, there is a necessary change in elevation between the outlet of the rock trap and the inlet of a dryer. As a result, the ductwork between these two components commonly contain at least two or three elbows 41 and some straight sections 42, each creating additional pressure drops.

Again, it is important to note that, by virtue of their need for the introduction of the reclaiming air (usually, from above the air-lock), prior art systems do not easily lend themselves to positive pressure conveyance, or push designs, along with the components described above.

Pursuant to the foregoing, it may be regarded as an object of the present invention to overcome the deficiencies of, and provide for improvements in, the state of the prior art as described above, and as may be inherent in the same, or as may be known to those skilled in the art. It is a further object of the present invention to provide a process and any necessary apparatus for carrying out the same, and of the foregoing character, and in accordance with the above objects, which may be readily carried out, with and within the process, and with comparatively simple equipment, and with relatively simple engineering requirements. Still further objects may be recognized and become apparent upon consideration of the following specification, taken as a whole, in conjunction with the appended drawings and claims, wherein by way of illustration and example, an embodiment of the present invention is disclosed.

As used herein, any reference to an object of the present invention should be understood to refer to solutions and advantages of the present invention, which flow from its conception and reduction to practice, and not to any a priori or prior art conception.

The above and other objects of the present invention are realized and the limitations of the prior art are overcome in the present invention by providing new and improved methods, process, and systems. A better understanding of the principles and details of the present invention will be evident from the following description taken in conjunction with the appended drawings.

BRIEF SUMMARY OF THE INVENTION

The present invention is directed to a system for, and a method of, (1) providing a practical and novel means by which to blend seed cotton, fiber, or similar light-weight materials, from more than one source or lot, at a time, whilst the material is being pneumatically conveyed (e.g. blending different material/fiber types, or blending the same material/fiber type where the singular type is from sources or lots of varying characteristics or qualities); (2) providing a practical and novel means by which to encourage the separation of any agglomerated seed cotton, fiber, similar light-weight materials, or related matter like rocks, seeds, husks, or other heavy foreign nonuseful matter; (3) introducing a spiraling motion for the material throughout the entire device, to promote a tumbling action for each individual lock of seed cotton, or quantum of material, thereby improving the blending and conditioning efficiency; and (4) creating a central, rotating vertical column of conveying air within the blending chamber, with the vertical column eventually being separated to create a distribution of the blended material.

In an exemplary embodiment, the vortex tube system is for conditioning a first lot of fiber comprising a first fiber type, where the system is for accomplishing a blending of the first lot as it is fluidly conveyed. It is envisioned that a lot hypothetically may comprise varies types of fiber, and that certain qualities and characteristics define a particular lot (and the particular fiber types therein, for example, or the particular grades or tiers of a single fiber type therein, for example) from other lots. In another exemplary embodiment, the vortex tube system may be configured to receive fiber from a second lot of fiber, wherein the second lot of fiber also comprises the first fiber type, such that the vortex tube system also is for accomplishing a blending in aggregate of the first fiber type, regardless of the source lot, as it is fluidly conveyed.

In another exemplary embodiment, the vortex tube system may be further configured to receive a second fiber type into the system, from a second lot of fiber comprising the second fiber type, such that the vortex tube system also is for accomplishing a blending between the first fiber type and the second fiber type as it is fluidly conveyed.

Thus, at least three different approaches are contemplated by the present invention, all of which are covered by the inventive concept.

More specifically, and with more non-limiting particularity, the present invention is directed to a vortex tube system for conditioning at least a first fiber in a fluidly conveyed stream, and for blending the first fiber with at least a second fiber, wherein, the second fiber also may be in the fluidly conveyed stream. In one exemplary embodiment, the vortex tube system is defined by a tubular housing containing a vertical central tube defining an interior between a top end and a bottom end. The vertical central tube is partially circumscribed by a spiraling inlet housing in fluid communication with the bottom end of the vertical central tube. The spiraling inlet housing may be accessible via at least two inlet transition sections, where the at least two inlet transition sections are configured to tangentially introduce the first fiber and the second fiber, respectively, into the spiraling inlet housing.

In the above exemplary embodiment, the fibers are introduced without mixing of the fibers, until the fibers are introduced into the vortex tube system. Further, the vertical central tube for the embodiment may comprise a plurality of fixed helical vanes situated about the interior of the vertical central tube, wherein the plurality of fixed helical vanes homogenizes the fibers in the fluidly conveyed stream. Further, the tubular housing may include a head forming a diverter dish for directing the fibers in the fluidly conveyed stream to a tangential fiber discharge outlet, and for further homogenizing the fibers in the fluidly conveyed stream.

The present invention also is directed to a conditioner and blender system for fibers entrained in an airstream, wherein a central vertical tube defines an air passage from a lower separating chamber to an upper drying chamber. In an exemplary embodiment, the lower separating chamber includes at least two inlet transition sections, a spiraling intake guide, and an access port. Each of the inlet transition sections accesses the lower separating chamber and are configured to tangentially introduce at least a first fiber and at least a second fiber, respectively, into the spiraling intake guide. Again, in this exemplary embodiment, this is without mixing of the fibers until the fibers are introduced into the conditioner and blender system.

In the above exemplary embodiment, the system comprises (1) a deflector, (2) helical vanes, and (3) a tangential fiber discharge outlet (e.g., fluid conveyed outwardly and downwardly to a tangential fiber discharge outlet, which would be understood by a person having ordinary skill in the art to have the technical effect of directing the flow of conveyed fiber, e.g. cotton, prior to directing the fluid to enter the cylindrical chamber above) and meeting the flow of conveyed fiber along with the conveying air. Further, there would be no counter flowing streams, only coincidental streams of cotton and air coming from a single, common source. Thus, the helical vanes act in much the same way as rifling in the bore of a gun.

Also in the above exemplary embodiment, the helical spinner vanes are attached to the wall of the inlet tube and meet the flow of cotton along with the conveying air prior to entering the cylindrical chamber above. The helical spinner vanes are attached to the wall along one edge and are very few in number, to prevent the collection of fiber, and the length to width ratio approaches 20.0. Vanes in known systems are usually used to break up and expose multiple surfaces of the bulk mass to promote reaction with the gas being emitted from the stream jet (for certain embodiments in the field), and do not act in much the same way as rifling in the bore of a gun.

Further, in the above exemplary embodiment, the access port selectively introduces air into the lower separating chamber to promote airflow upwardly alongside the airstream. The spiraling intake guide may deliver the fibers entrained in the airstream to an inlet to the central vertical tube. In one exemplary embodiment, the central vertical tube includes a plurality of fixed helical vanes extending inwardly to homogenize the fibers entrained in the airstream. The upper drying chamber includes an upper deflector head, positioned above the central vertical tube, and a tangential fiber discharge outlet, positioned below the deflector head.

In other exemplary embodiments, the invention can comprise one or more of the following features, alone or in various combinations:

A spiraling intake guide defined by (1) an inner wall along the central vertical tube, (2) an outer wall of the lower separating chamber, (3) a downwardly spiraling lower wall, (4) a connecting wall extending tangentially from the central vertical tube, between the central vertical tube and the outer wall, and (5) a downwardly spiraling partition spaced above the downwardly spiraling lower wall, and separating the drying chamber from the separating chamber and defining a base of the tangential fiber discharge outlet;

A downwardly spiraling lower wall extending below the central vertical tube into the lower separating chamber;

A central vertical tube extending below the downwardly spiraling lower wall into the lower separating chamber;

A central vertical tube leading to the tangential fiber discharge outlet wherein the airstream is directed downwardly toward the tangential fiber discharge outlet;

A plurality of downwardly extending diverter vanes to direct the airstream from the outlet of the central vertical tube;

An access portion communicating with the lower separating chamber and positioned subjacent the lower separating chamber to remove matter dropped from the airstream;

A spiraling intake guide as an involute scroll positioned subjacent the central vertical tube and diminishing in radius towards the central vertical tube with the involute scroll affixed to a bottom wall with the bottom wall having a radially upward inclination increasing as the involute scroll radius diminishes;

A tangential inlet for the airstream is defined by an inner wall of the involute scroll and a vertical wall spaced from the involute scroll and extending to a point immediately below the inner wall of the central vertical tube;

A vertical wall extending below the central vertical tube as a conic section;

A lower separating chamber and an upper drying chamber, both separated by a downwardly spiraling partition with the central vertical tube passing through the downwardly spiraling partition and sealed to the downwardly spiraling partition;

An upper drying chamber including a floor inclined relative to the central vertical tube upwardly from the tangential fiber discharge outlet;

A tangential fiber discharge outlet formed by (1) an outer wall of the central vertical tube, (2) an outer wall of the upper drying chamber, (3) a floor spiraling downwardly about the central vertical tube, and (4) a connecting wall extending tangentially from the outer wall of the central vertical tube;

A tangential fiber discharge outlet formed by (1) the outer wall of the central vertical tube, (2) an outer wall of the upper drying chamber, (3) a downwardly spiraling partition forming a floor about the central vertical tube, and (4) a connecting wall extending tangentially from the outer wall of the vertical tube to the outer wall of the upper drying chamber;

A vertical central tube defining an air passage from a lower separating chamber to an upper drying chamber, and wherein the spiraling inlet housing is defined by (1) an inner wall defining the vertical central tube, (2) an inner wall of the tubular housing, (3) an outer wall of the lower separating chamber, (4) a downwardly spiraling lower wall, (5) a connecting wall extending tangentially from the vertical central tube, the connecting wall located between the vertical central tube and the outer wall, and (6) a downwardly spiraling partition spaced above the downwardly spiraling lower wall, the downwardly spiraling lower wall separating the tubular housing into the upper drying chamber and the lower separating chamber;

A spiraling inlet housing defined by an involute scroll positioned subjacent the vertical central tube and diminishing in radius towards the vertical central tube with the involute scroll affixed to a bottom wall with the bottom wall having a radially upward inclination increasing as the involute scroll radius diminishes and a vertical wall spaced from the involute scroll and extending tangentially from a point immediately below the wall of the vertical central tube to the wall of the tubular housing;

A tubular housing defining a drying chamber that includes a floor inclined relative to the vertical central tube upwardly from the tangential fiber discharge outlet;

At least a second fiber in the fluidly conveyed stream blended and conditioned; and/or A vortex tube system operating without, or essentially without, a need for introducing reclaiming air into the system.

BRIEF DESCRIPTION OF THE DRAWINGS

In the figures, like reference numerals refer to like parts throughout the various views unless otherwise indicated. For reference numerals with letter character designations such as "102*a*" or "102*b*", the letter character designations may differentiate two like parts or elements present in the same figure.

Figure 1:
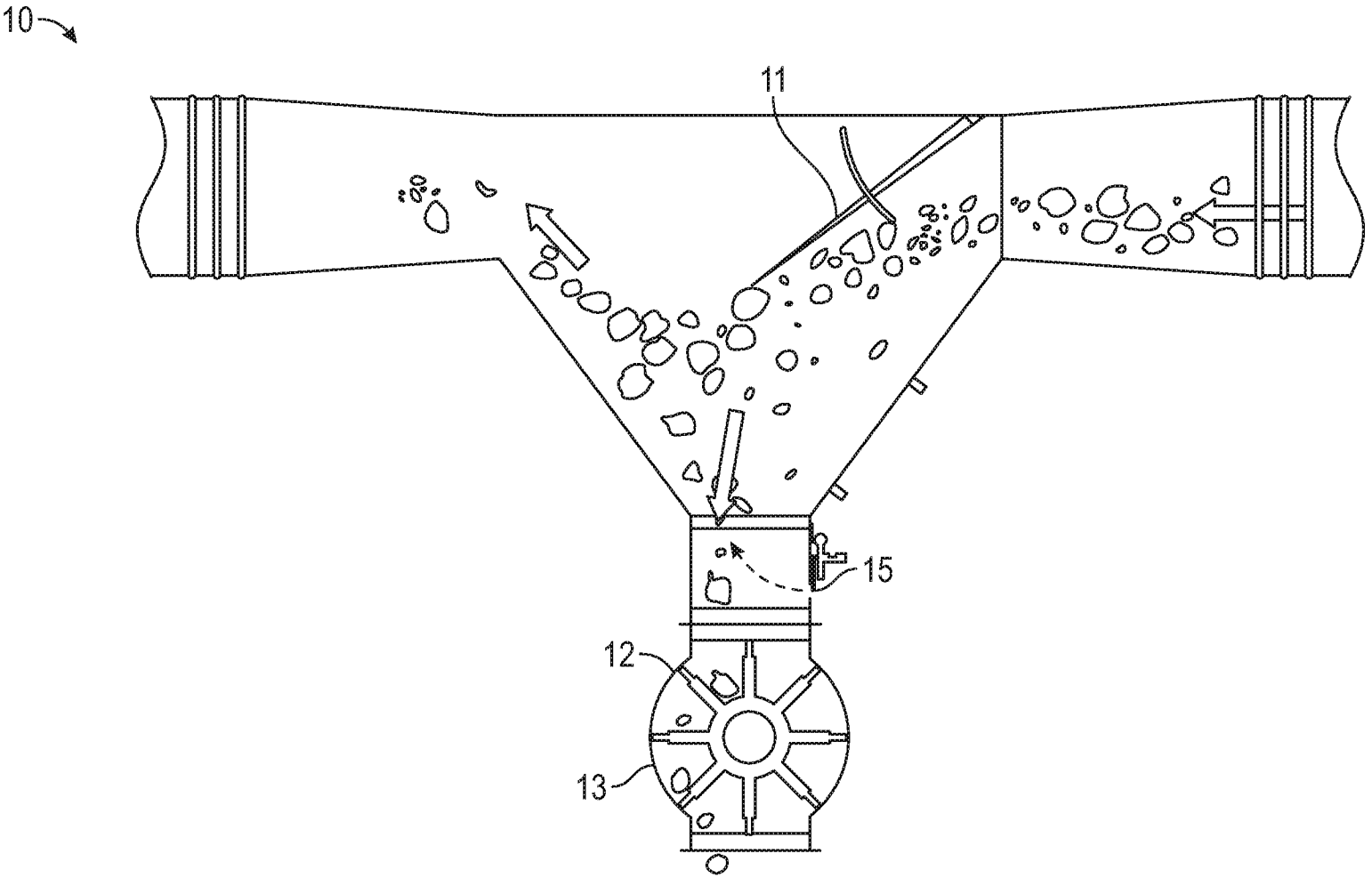
FIG. 1 (Prior Art)
FIG. 1 is a side cross section view of an exemplary embodiment of a prior art hopper-type rock and green boll trap, and is taken from the USDA Cotton Ginners Handbook, December 1994, page 57.

The drawings constitute a part of this specification and include exemplary embodiments of the present invention, which may be embodied in various forms. It is to be understood that in some instances various aspects of the invention may be shown as exaggerated, reduced, enlarged, or otherwise distorted to facilitate an understanding of the present invention. In the drawings, like elements are given the same or analogous references when convenient or helpful for clarity. The same or analogous reference to these elements will be made in the body of the specification, but other names and terminology may also be employed to further explain the present invention.

DETAILED DESCRIPTION OF PREFERRED EMBODIMENTS

For a further understanding of the nature, function, and objects of the present invention, reference should now be made to the following detailed description taken in conjunction with the accompanying drawings. While detailed descriptions of the preferred embodiments are provided herein, as well as the best mode of carrying out and employing the present invention, it is to be understood that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure, or manner. The practice of the present invention is illustrated by the included examples, which are deemed illustrative of both the process taught by the present invention and of the results yielded in accordance with the present invention.

The present invention is applicable to blending and conditioning processes for a singular stream (or lot) of material, or for combinations of two or more streams (or lots). As used herein, the term "blending" carries the customary meaning as is understood by a person having ordinary skill in the art;

however, the term "blending" also carries the following meanings: blending different material/fiber types; blending the same material/fiber type, where the singular type is from sources or lots of varying characteristics or qualities; and equivalents thereof.

Further, for a single input stream, certain embodiments of the present invention not only dry the seed cotton but also concomitantly enhance the efficiency of the immediately subsequent processes that usually follow such a conditioning and blending system (e.g., seed cotton cleaning equipment and processes). This is accomplished by providing a separation effect on any agglomerations in the fluidly conveyed stream, which in certain embodiments results in fibers in a single-locked state. This is applicable to multiple input embodiments as well (described in greater detail herein).

Generally, exemplary embodiments of the present invention provide a system for and a method of satisfying at least one of the following non-limiting objectives:

- to provide a practical and novel means by which to blend seed cotton, fiber, or similar light-weight materials, from more than one source or lot, at a time, whilst the material is being pneumatically conveyed;
- to provide a practical and novel means by which to encourage the separation of any agglomerated seed cotton, fiber, or similar light-weight materials, or related matter like rocks, seeds, husks, or other heavy foreign nonuseful matter, thereby improving the efficiency of downstream processes like seed cotton cleaning, etc.;
- to introduce a spiraling motion for the seed cotton throughout the entire device, to promote a tumbling action for each individual lock of seed cotton, or quantum of material, thereby improving the blending and conditioning efficiency (for example, this spiraling motion begins at an inlet for feeding seed cotton optionally from more than one source continues through a central vortex tube equipped with fixed spinner vanes, and encouraged to continue in a spiral-path, due to the unique ceiling of the blending chamber, out through the exit of the device);
- to create a central, rotating vertical column of conveying air within the blending chamber, with the vertical column eventually being separated by a centrally suspended cone to create a distribution of seed cotton around the perimeter of the chamber prior to its downward path; the ceiling of the blending chamber being of a curved shape such that it encourages the seed cotton path to potentially take on the shape of a torus, or doughnut, thereby inducing a compound direction of spin for each lock of seed cotton, thus further improving blending and conditioning efficiency. For example, by virtue of the centrally rising column of conveying air and seed cotton piercing the path falling down around the perimeter, a cylindrically shaped pneumatic sheer plane is created where the two pass each other, one inside the other, as seen from above, this sheer plane further increasing turbulence at the boundary layer between the two, and further encouraging the continuation of a torus-shaped path of the descending seed cotton.

In an exemplary embodiment, an object of the present invention is to blend an input of cotton, or a plurality of inputs of cotton of the same or different types or qualities, such as seed cotton, to result in a homogenized or more homogenized output of cotton for further processing or treatment. Thus, a focus of the invention is on blending for inherent fiber qualities. Further, in a multiple input stream variation, an object of the present invention is to provide for mitigation of environmental factors by blending similar variety cottons having dissimilar physical characteristics. Thus, another focus of the invention is on blending for mitigations of factors like trash content (e.g., leaf, steams, and burs), moisture, preparation, exposure, etc., in contrast to blending for inherent fiber qualities. For example, attention is drawn to the benefits of blending some of the hurricane affected cottons out of hurricane/flood affected areas with some of the better conditioned cotton from immediately surrounding areas.

Similarly, cotton harvested late in the season, for example, may be darker (lower in color grade) in many cases. Floods or heavy rains also can lower the color grade. Moisture content both before and after baling also can affect the color grade. Freezes, or insect damage, or reaction to fungi also can lower the color grade. Blending helps raise the value of lower color grade material/fiber when judiciously blended, either with similar cotton of higher color grade and/or with dissimilar cotton altogether.

In another exemplary embodiment, an object of the present invention is to provide a simple, novel device for removing undesirable materials, such as rocks and green cotton bolls, from input cotton, such as seed cotton. The inventive device can be integrated into a system employing either positive or negative conveying air streams within the blending and conditioning component, thereby removing the connecting ductwork and elbows between these two functions, and reducing the energy losses introduced by the ductwork and elbows connecting the two. This also reduces the footprint for both functions.

In still another exemplary embodiment, an object of the present invention is to devise a means for separating the rocks and green cotton bolls using a cyclonic inlet, thus reducing the energy requirements for this step of the process as compared to traditional hopper-type rock traps and the like.

In yet another exemplary embodiment, an object of the present invention is to convey the seed cotton out of the rock trap and into the blending and conditioning chamber without, or essentially without, the need for the introduction of reclaiming air, thus reducing the energy losses as compared to traditional systems.

In another exemplary embodiment, an object of the present invention is to provide a system for and method of conditioning a first lot of fiber comprising a first fiber type, where the system or method is for accomplishing a blending of the first lot as it is being fluidly conveyed. It is envisioned that a lot hypothetically may comprise varies types of fiber, and that certain qualities and characteristics define a particular lot from other lots. A lot may comprise two or more fiber types, for example, or a lot may comprise the particular grades or tiers of a single fiber type, for example.

In still another exemplary embodiment, an object of the present invention is to provide a system for and method of conditioning fiber received from a second lot of fiber, wherein the second lot of fiber also comprises the first fiber type, such that the vortex tube system also is for accomplishing a blending, in the aggregate, of the first fiber type within the system, regardless of the source.

In yet another exemplary embodiment, an object of the present invention is to provide a system for and method of conditioning a second fiber type received into the system, from a second lot of fiber comprising the second fiber type, such that the vortex tube system also is for accomplishing a blending between the first fiber type and the second fiber type as it is fluidly conveyed. Again, this is regardless of the source lot, but involves a blending of at least two fiber types, instead of a blending of a single fiber type but where the composition introduced into the system is of varying characteristics or qualities.

Turning now to the figures, one or more of the above objects can be achieved, at least in part, by providing a modified vortex tube dryer. Various exemplary embodiments of a vortex tube dryer 50, upon which the instant invention claims priority, are shown in FIGS. 6-16. Beginning at FIG. 6, a first exemplary embodiment of a vortex tube dryer 50 is shown including a cylindrical body 51 with a head 52 of dished or concave shape containing a suspended splitter cone 53. An inlet 54 allows seed cotton and air to enter the cylindrical body 51 in a tangential manner into a ductwork with a rectangular cross section defined by an upper wall 57, a lower wall 59, an inside wall 55*a*, and an outside wall 60, which ductwork causes the airflow and entrained seed cotton to follow a downward spiraling path. The inside vertical wall of this rectangular cross section wraps around a central vertical vortex tube 55. As the inlet path wraps downward around the vortex tube 55, the cross section enlarges thus reducing the velocity of the hot air and seed cotton.

Figure 7:
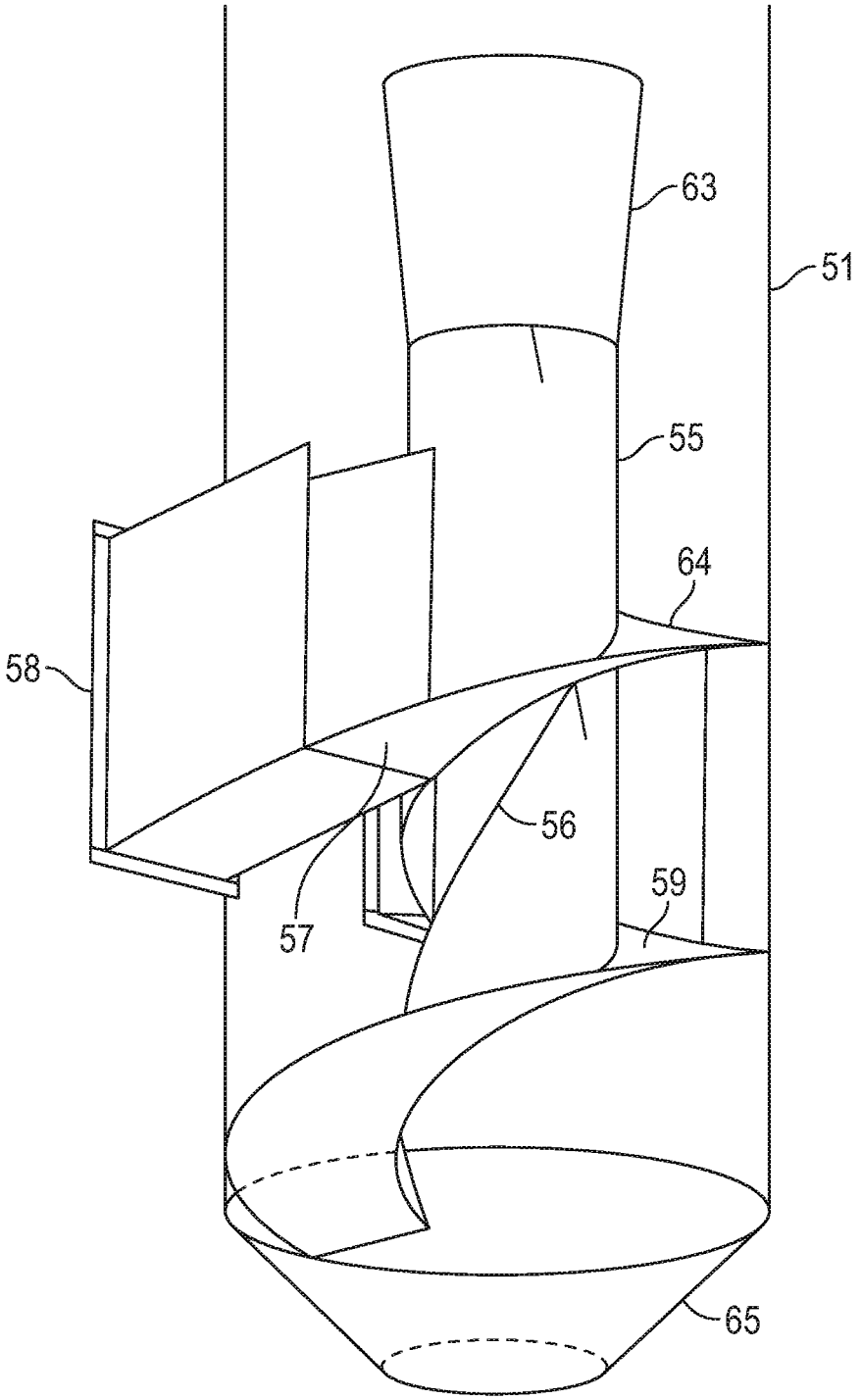
FIG. 7 is a sectional view of an exemplary embodiment of a tangential inlet, outlet, and vortex tube of the dryer shown in FIG. 6.

This cross sectional enlargement can be achieved in more than one way. One means of enlargement is by means of the upper wall 57 of said rectangular inlet duct leveling out to form the lower floor of the superjacent outlet 58, thereby increasing the vertical height of the rectangular inlet duct. Another means of enlargement is by means of the introduction of a gradually tapered spiral opening 56 in the inner wall 55*a* being coincident with the outer wall of the vortex tube 55. The tapered opening 56 or vortex tube inlet then creates a sharp turn for the hot air and seed cotton. The lower wall 59 of the rectangular inlet duct continues downward in the same spiral fashion until terminating near the bottom of the cylindrical body 51. FIG. 7 further illustrates several of these components.

Returning to FIG. 6, the separation of rocks, green bolls, and heavy foreign matter takes place below the inlet 54 by virtue of two actions. First, the heavier-than-seed-cotton material tends to follow the outer wall 60 of the tangential inlet, such that the inlet duct acts like a cyclone tending to sling the heavy material outward as the air follows a circular path. Second, the difference in the mass of the individual locks of seed cotton and the basic effects of the momentum formula for an object of p=my on the system, where p represents momentum, m represents mass of the object, and v represents velocity of the object. The smaller mass seed cotton has less momentum and tends to follow the air stream into the tapered spiral opening 56, and thus the seed cotton is peeled away from the trajectory of any more massive materials, such as rocks and green bolls, which are unable to make the sharp turn due to their higher momentum. The separation action of a cyclone is well understood by a person having ordinary skill in the art.

A cone 65 is attached to the bottom of the cylindrical body 51, and below the cone 65 is a round to rectangular transition 61. Below the transition is an air lock 12 either of a rotary design 13 (see FIG. 1) or of a double-door design 14 (see FIG. 6). Next, the rocks and green bolls are then dropped out of the system into a barrel 43, some other suitable container, or some other means of conveyance.

With emphasis on the system above the inlet 54, the velocity of the hot air and seed cotton entering the vortex tube 55 increases due to the decrease in cross sectional area.

Figure 8:
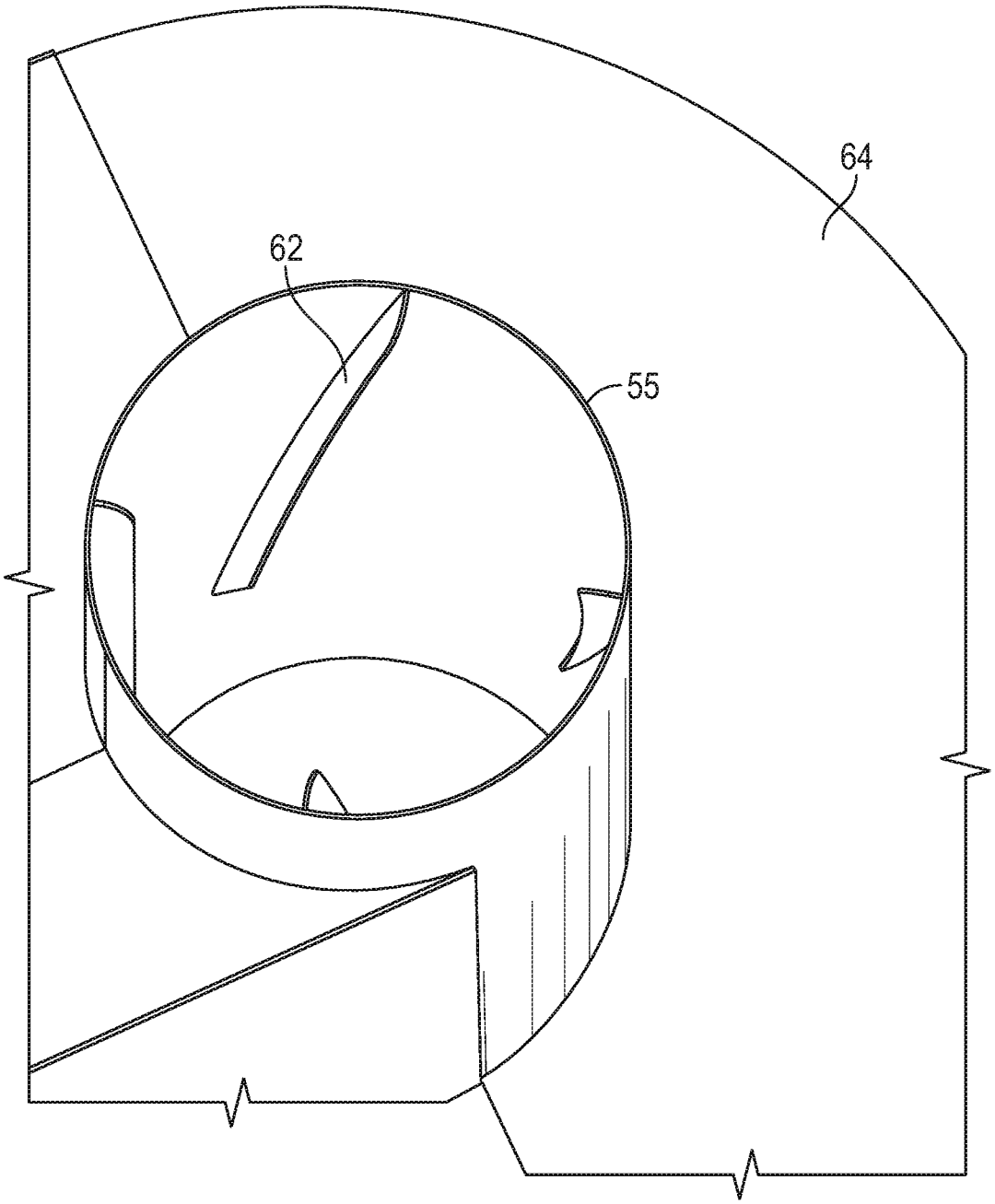
FIG. 8 is a partial sectional view of the dryer shown in FIG. 6.
Figure 9:
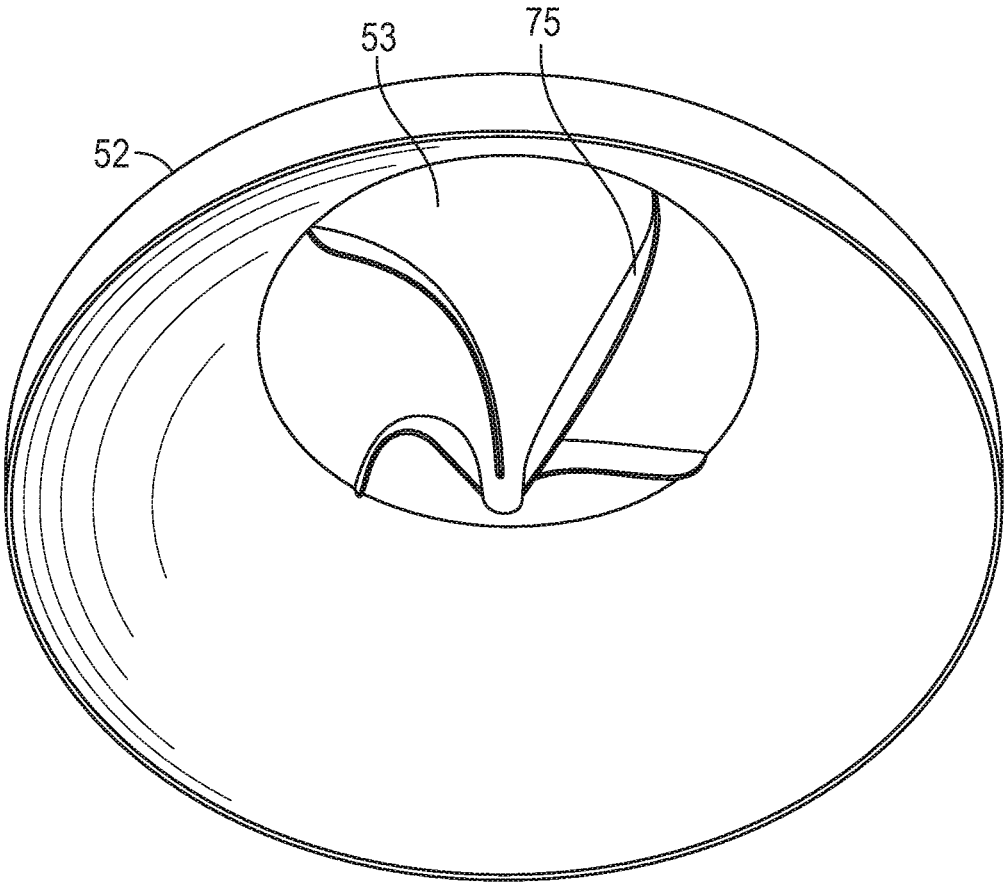
FIG. 9 is a perspective view of an exemplary embodiment of a dished head and splitter cone of the dryer shown in FIG. 6.

An exemplary embodiment of the inside of the vortex tube 55 is shown in FIG. 8. The vortex tube 55 contains helical spinner vanes 62 extending inwardly and diagonally relative to the vortex tube, which will encourage the continued spiral path of the hot air and seed cotton. Above the vortex tube is a diffuser nozzle 63 (see FIG. 7) designed to reduce the pressure drop as the hot air and seed cotton enter the relatively larger cross section created by the cylindrical body 51.

Figure 6:
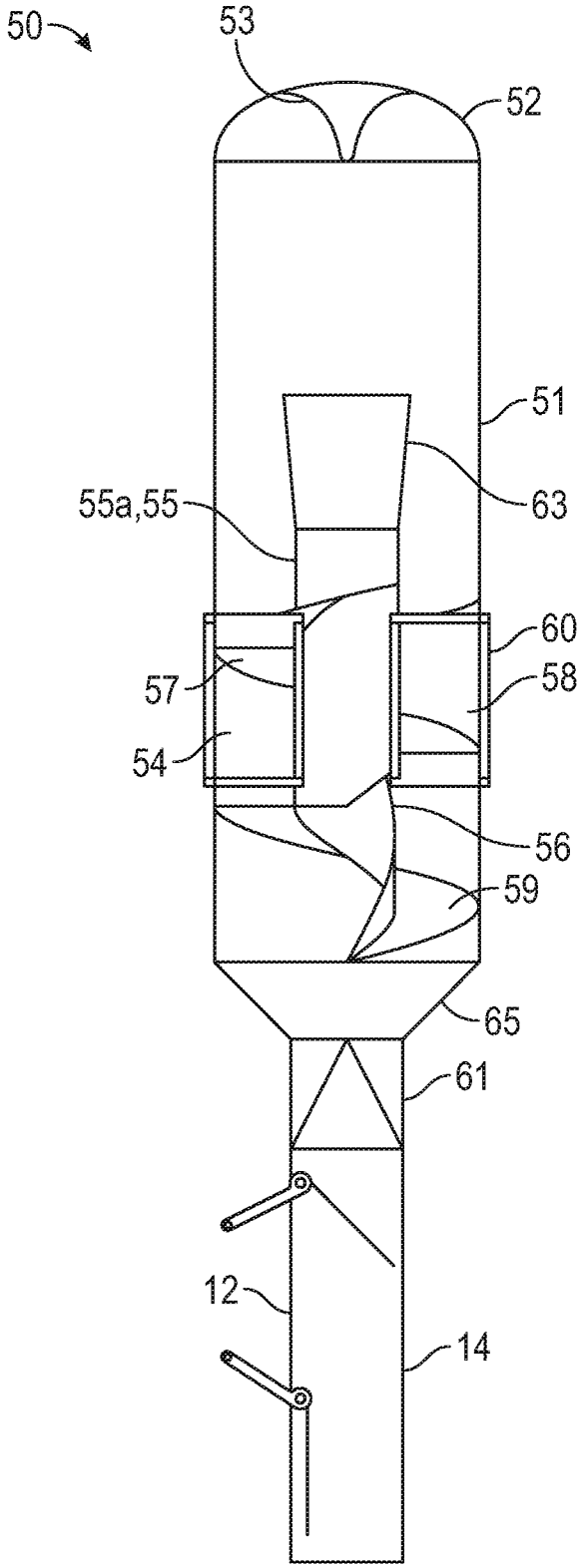
FIG. 6 is a sectional view of a first exemplary embodiment of a vortex tube dryer upon which the present invention claims priority.

As the rising column of seed cotton reaches the splitter cone 53 and dished head 52 (see FIG. 6) it will spread around the perimeter wall of the cylindrical body prior to falling back down onto the spiral exit ramp floor 64 created by virtue of being the other side of the material used to make up the upper wall 57 of the rectangular inlet 54 (see FIG. 6). The concomitant motion of the centrally rising column of conveying air and seed cotton exiting the vortex tube and the descending air moving toward the tangential outlet 58 (see FIG. 7) create a cylindrically shaped pneumatic sheer zone where the air moving in opposite vertical directions pass each other, one inside the other as seen from above, thereby further increasing turbulence at the boundary between the two and furthering the encouragement of the continuation of a torus-shaped path of the descending seed cotton. The rectangular tangential outlet 58 is formed on the bottom by the spiral exit ramp floor 64, on the outside by the wall of the cylindrical body 51, and on the inside wall by the vortex tube 55.

Optionally, a series of spinner vanes 75 may be affixed to the surface of the splitter cone 53 arranged in a spiral pattern (see FIG. 9), thus encouraging the seed cotton to continue in spiraling path as it traverses the dished head 52. A person having ordinary skill in the art understands that the head 52 may be dished, spherical, elliptical, or flat and still maintain the spirit thereof.

Figure 10:
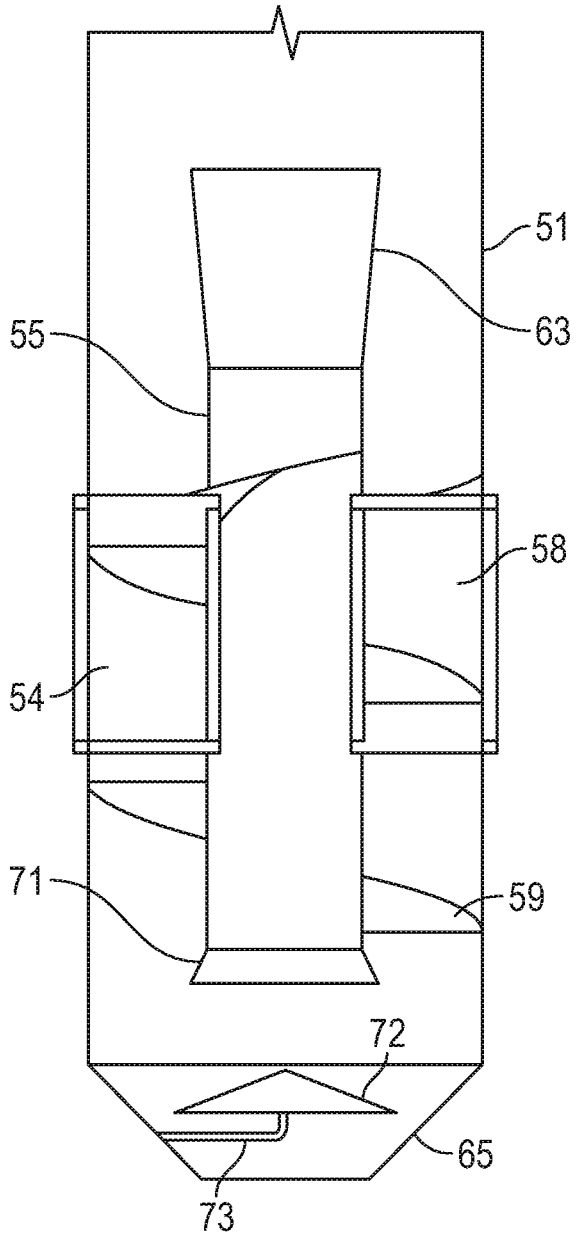
FIG. 10 is a sectional view of a second exemplary embodiment of a vortex tube dryer upon which the present invention claims priority, showing the vortex tube with the diffuser nozzle.

A second embodiment of the vortex tube dryer is shown in FIG. 10 where the inlet of the vortex tube 55 does not have a tapered spiral opening. The vortex tube inlet optionally may include an inlet nozzle 71. Further, directly below the vortex tube inlet is an optional vortex breaker 72 that may be conical, spherical, elliptical, or flat in cross section. This vortex breaker 72 may be supported from beneath, and this support 73 may also be adjustable to place the vortex breaker 72 in an optimal position.

Support 73 may include hydraulic or mechanical actuators to move the vortex breaker horizontally and vertically in a known manner. The vortex breaker 72 adjustment may include not only a change in elevation, but may include provision for a location change bringing the vortex breaker into a position no longer central to the cylindrical body 51 and/or the cone 65 and/or the vortex tube 55. This adjustment allows for a change in angular position of the central axis of the vortex breaker 72 relative to the cylindrical body 51 or the cone 65 or the vortex tube 55. All or some features unique to the second exemplary embodiment may be combined with each other and/or included with features described for the first exemplary embodiment, and still maintain the spirit thereof.

Further, the cylindrical body or housing 51 in any of the exemplary embodiments of the dryer described herein may be made up of a multi-faceted wall with as few as four facets instead of having a smooth, curving surface wall, and that some components may also be faceted in a similar manner and still maintain the spirit thereof.

Figure 11:
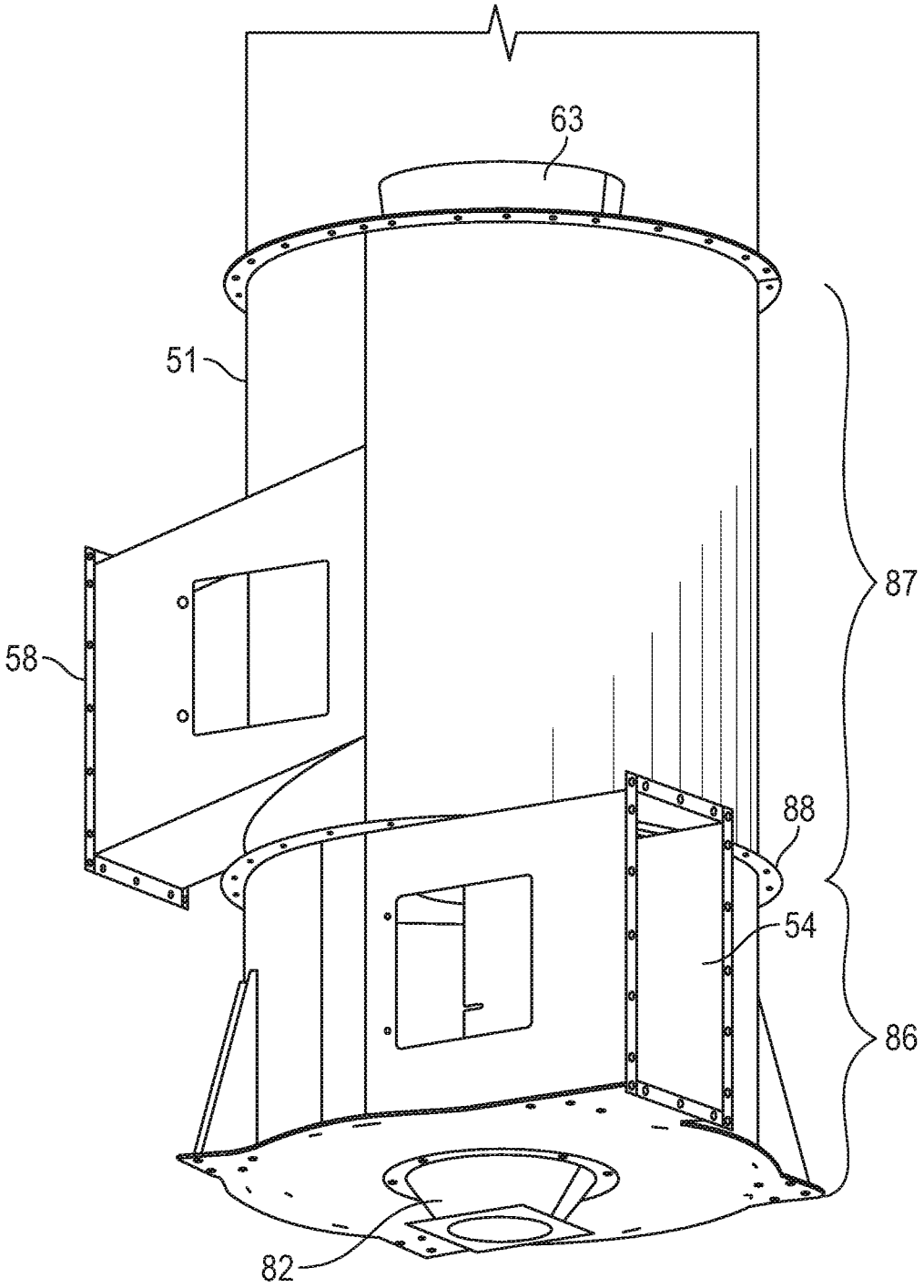
FIG. 11 is a partial perspective view of an exemplary embodiment of an inlet section and outlet section of a third exemplary embodiment of a vortex tube dryer upon which the present invention claims priority.
Figure 12:
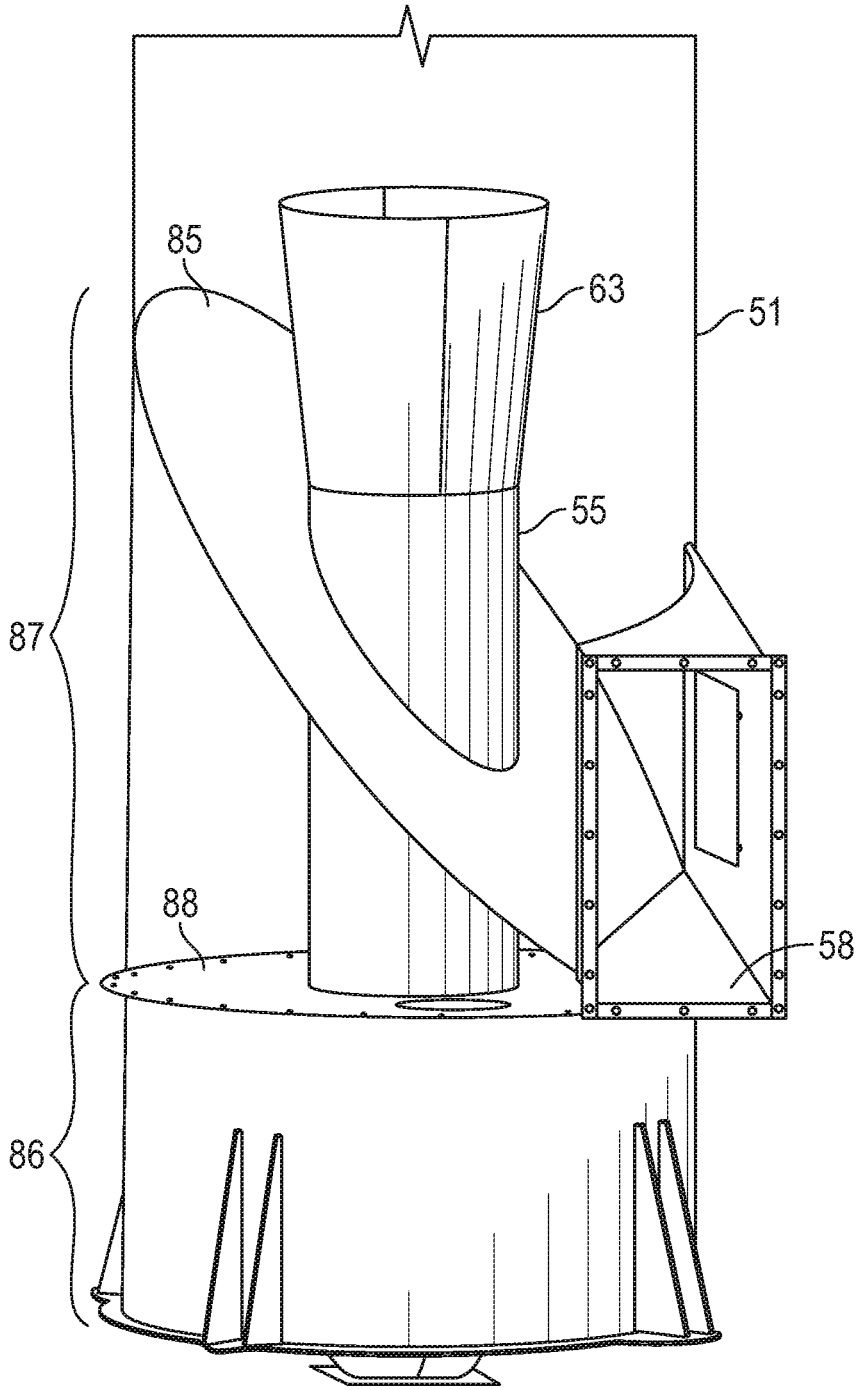
FIG. 12 is a sectional view of an exemplary embodiment of a tangential outlet section of the dryer shown in FIG. 11.

A third exemplary embodiment of the vortex tube dryer is shown in FIGS. 11 and 12 where the tangential inlet 54 and tangential outlet 58 are at differing elevations. The inlet section 86 of this exemplary embodiment is separated from the outlet section 87 by a solid divider sheet 88 with a central hole of the same diameter as the vortex tube 55 (see FIG.

12). This divider sheet 88 forms the roof of the inlet section 86 and serves as the origination of the inlet point of the vortex tube 55 (see FIG. 12). A tangential inlet 54 enters the cylindrical body 51 near the bottom and the spiral inlet path points upward.

Figure 13:
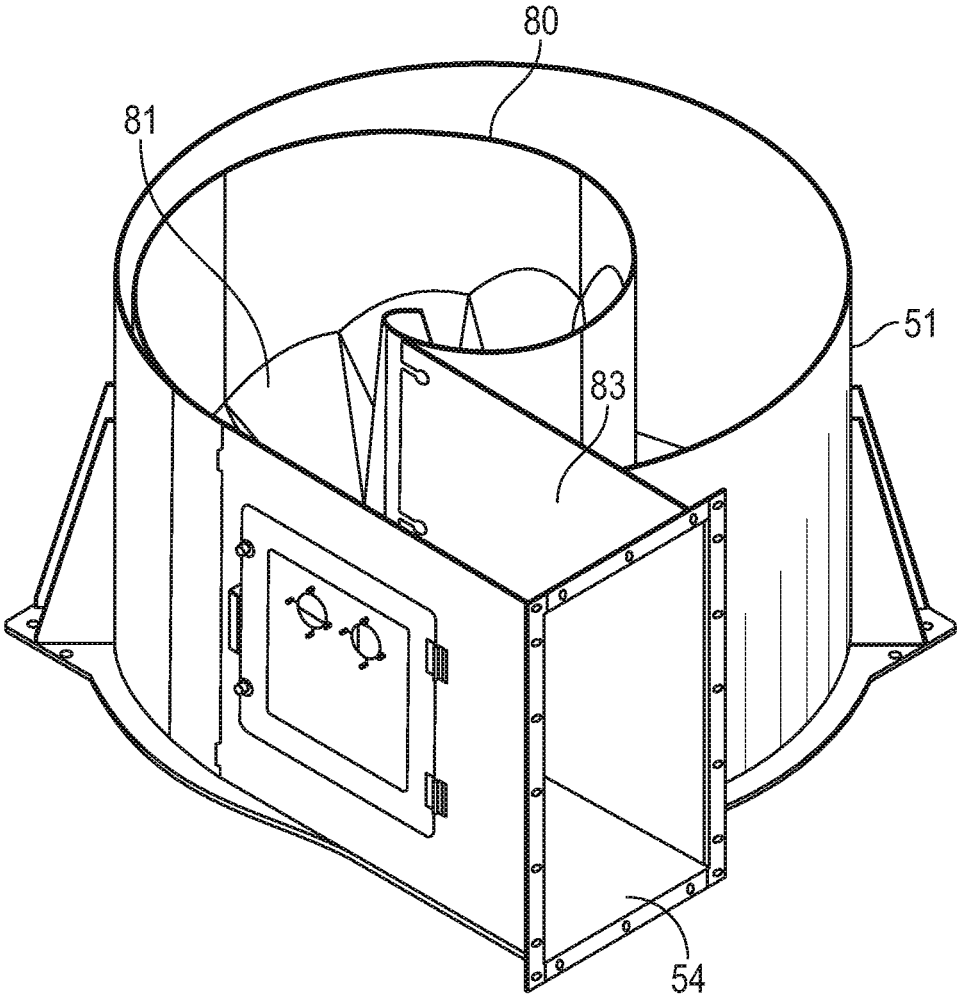
FIG. 13 is a perspective sectional view of the exemplary embodiment of the inlet section of the dryer shown in FIG. 11.
Figure 14:
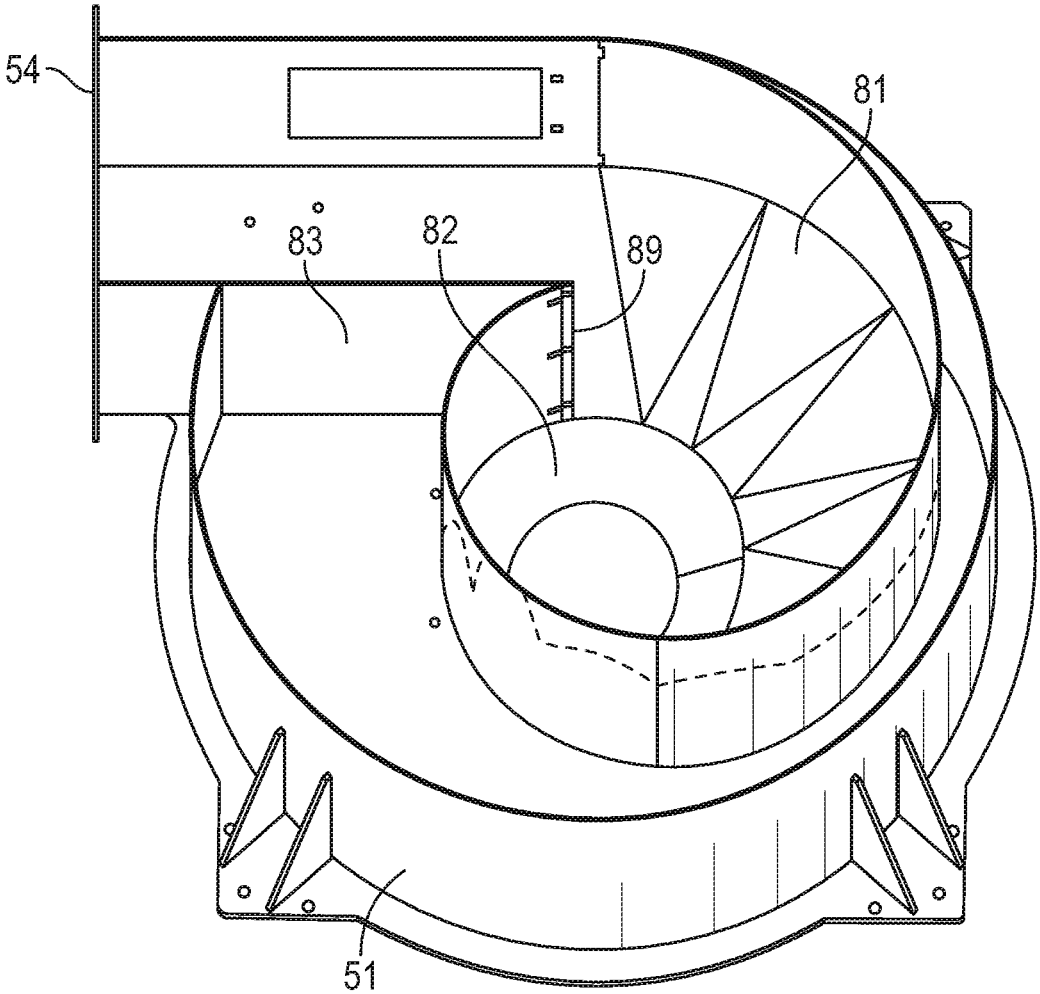
FIG. 14 is a perspective sectional view of a second exemplary embodiment of an inlet section of the dryer shown in FIG. 11.

As seen in FIG. 13, this upward directionality is achieved by combining an involute scroll-type vertical wall 80 and radially upward ramping floor 81 in order to encourage the seed cotton to begin the spiraling motion immediately prior to entry into the central vortex tube. A person having ordinary skill in the art understands that "radially upward ramping" means that the portion of the floor closest to the involute scroll is higher than the distal portion closest to the axis of the vertical tube. Further, the angle of inclination of the upwardly ramping floor increases as the involute spiral wall curves toward the vortex tube. Thus, the upward ramping floor 81 increases in angular pitch from the central axis of the vortex tube such that as the path of the involute wall 80 approaches completion of 180 degrees of rotation around the central axis, the floor angle becomes parallel to the wall forming a partial near-cylindrical area immediately beneath the vortex tube. In addition to inducing the spiraling motion of seed cotton, this shape creates a somewhat gradual transition in cross-sectional area between the tangential inlet of the cylindrical body and the inlet at the bottom of the vortex tube in order to accelerate the seed cotton in such a manner as to minimize the energy losses associated with abrupt pressure drops and undesirable eddy currents.

While the seed cotton is carried immediately upward into the accelerating air stream entering the vortex tube, the relatively heavier items like rocks or green bolls tend to follow the outer wall of the involute scroll, in an ever-tightening path toward the center where it will tend to reduce in velocity, drop out of the conveying air stream, fall into a cone 82 (see FIG. 11) attached to the floor at the bottom of the cylindrical body, drop into air lock 12 (see FIG. 6), and exit the system as demonstrated in previously described embodiments.

Further, returning to FIG. 13, the vertical walls of the tangential inlet are defined on the outside by the involute scroll 80, and on the inside by a vertical wall 83 that ends near the point where the plane defined by this inside wall meets at or near the tangent point 89 of the downward imaginary cylindrical projection of the wall of the vortex tube immediately above. This inner wall 83 may stop abruptly at this tangent point 89 (see FIG. 14), or may be fitted with a variety of scroll extensions (see FIG. 15), so shaped to prevent the separated matter like rocks and green bolls from being reintroduced into the air stream entering the vortex tube. One such scroll extension may be described as a portion of a cylinder or as the continuation of the ever-tightening involute scroll. Another shape may be described as a portion of a cone whose defining axis runs parallel or nearly parallel with the vortex tube. A cone version of this scroll extension 84 may be designed pointing up or down. Portions of the above described scroll extensions may be cut away or extended as required to obtain the desired results described herein.

An exemplary embodiment of an outlet section 87 for the third exemplary embodiment is shown in FIG. 12. Outlet section 87 is formed with the floor of the outlet being defined by a single or compound diagonal plane whose lower end terminates immediately prior to the rectangular tangential outlet 58, with said plane forming a singular canted disc 85 whose center is removed in such a way as to allow the cylindrical path of the vortex tube 55 to pass through this plane, and sealed both to the vortex tube and the inner walls of the cylindrical body 51 in order to maintain air pressure isolation between the inlet and outlet of the dryer. Alternatively, for this third exemplary embodiment, the outlet section 87 may be replaced with a rectangular tangential outlet 58 formed as shown in FIG. 7 with the spiral exit ramp floor 64.

Figure 16:
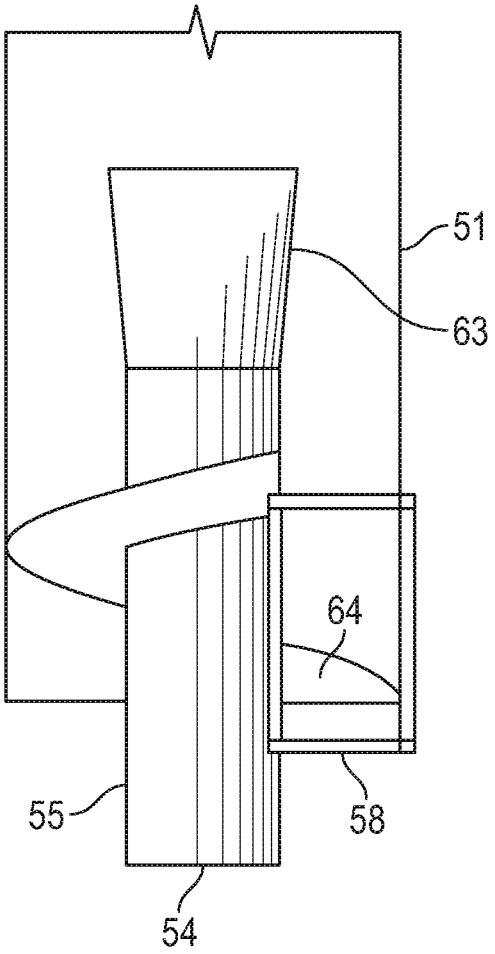
FIG. 16 is a sectional view of a fourth exemplary embodiment of a vortex tube dryer upon which the present invention claims priority.

A fourth exemplary embodiment of the vortex tube dryer is shown in FIG. 16 wherein the inlet 54 of the dryer is coincidental with the inlet point of the vortex tube 55. The spiral exit ramp floor 64 and dryer tangential outlet 58 remain as demonstrated in previously described embodiments and shown in FIG. 7 and FIG. 12. Alternatively for this fourth exemplary embodiment, the outlet section may be formed with the floor of the outlet being defined by a single or compound diagonal plane whose lower end terminates immediately prior to the tangential outlet 58, with said plane forming a singular canted disc 85 whose center is removed in such a way as to allow the cylindrical path of the vortex tube 55 to pass through this plane as best shown in FIG. 12.

With this background of the structure of the priority vortex tube dryer, the vortex tube blender and conditioner of the present invention will next be disclosed. While the inventive vortex tube blender and conditioner shares certain structural features with the priority vortex tube dryer, the distinctions and alterations will become apparent to one of ordinary skill in the art upon reading the following new disclosure.

One or more of the objects of the present invention may be achieved, at least in part, by providing a system for a vortex tube blender and conditioner 1050, various exemplary embodiments of which are shown in FIGS. 17-27. Beginning with FIG. 17, a first exemplary embodiment of a vortex tube blender and conditioner 1050 includes a cylindrical body 1051 with a head 1052, of dished shape, containing a suspended splitter cone 1053. The rectangular inlet 1054 allows seed cotton and air to enter the cylindrical body 1051 in a tangential manner. The first exemplary embodiment of the vortex tube blender 1050 has a generally similar structural composition as the third exemplary embodiment of the priority vortex dryer tube shown in FIGS. 11 and 12. The differences are described herein.

First, a multi-input transition, such as Y-transition 1021, is shown attached to the inlet 1054 to allow two or more separate streams of pneumatically conveyed material from different lots to join at the inlet 1054. Y-transition 1021 is attached to the inlet 1054 and may be of such a design as to allow more than two separate streams, from differing lots, to enter the tangential inlet 1054. Such a combining of multiple streams may also potentially take place farther upstream in the process at a different structure or component of the system 1050 than shown in the present embodiment.

Further, in the third exemplary embodiment of the priority vortex dryer tube shown in FIGS. 11 and 12, the inlet section 1086 of the first exemplary embodiment of the vortex tube blender and conditioner 1050 is separated from the outlet section 1087 by a solid divider sheet 1088 with a central hole of the same diameter as the vortex tube 1055 (see FIG. 12). This divider sheet 1088 forms the roof of the inlet section 1086 and serves as the origination of the inlet point of the vortex tube 1055 (see FIG. 18). The tangential inlet 1054 enters the cylindrical body 1051 near the bottom and the spiral inlet path points upward. This upward directionality is achieved by combining an involute scroll-type vertical wall 1080 (see FIG. 20) and upward ramping floor 1081 (see FIG. 20) in order to encourage the seed cotton to begin the spiraling motion immediately prior to entry into the central vortex tube. In addition to inducing the spiraling motion of seed cotton, this upward directionality creates a somewhat gradual transition in cross-sectional area between the tangential inlet of the cylindrical body and the inlet at the bottom of the vortex tube in order to accelerate the seed cotton in such a manner as to minimize the energy losses associated with abrupt pressure drops and undesirable eddy currents.

In particular, the upward ramping floor 1081 increases in angular pitch such that as the path of the involute wall 1080 approaches completion of 180 degrees of rotation around the central axis, the floor angle becomes parallel to the wall forming a partial near-cylindrical area immediately beneath the vortex tube. This is best seen in FIG. 13; wherein, the features 51, 54, 80, 81, 83, and 86 are equivalent to the features 1051, 1054, 1080, 1081, 1083, and 1086, respectively.

Figure 15:
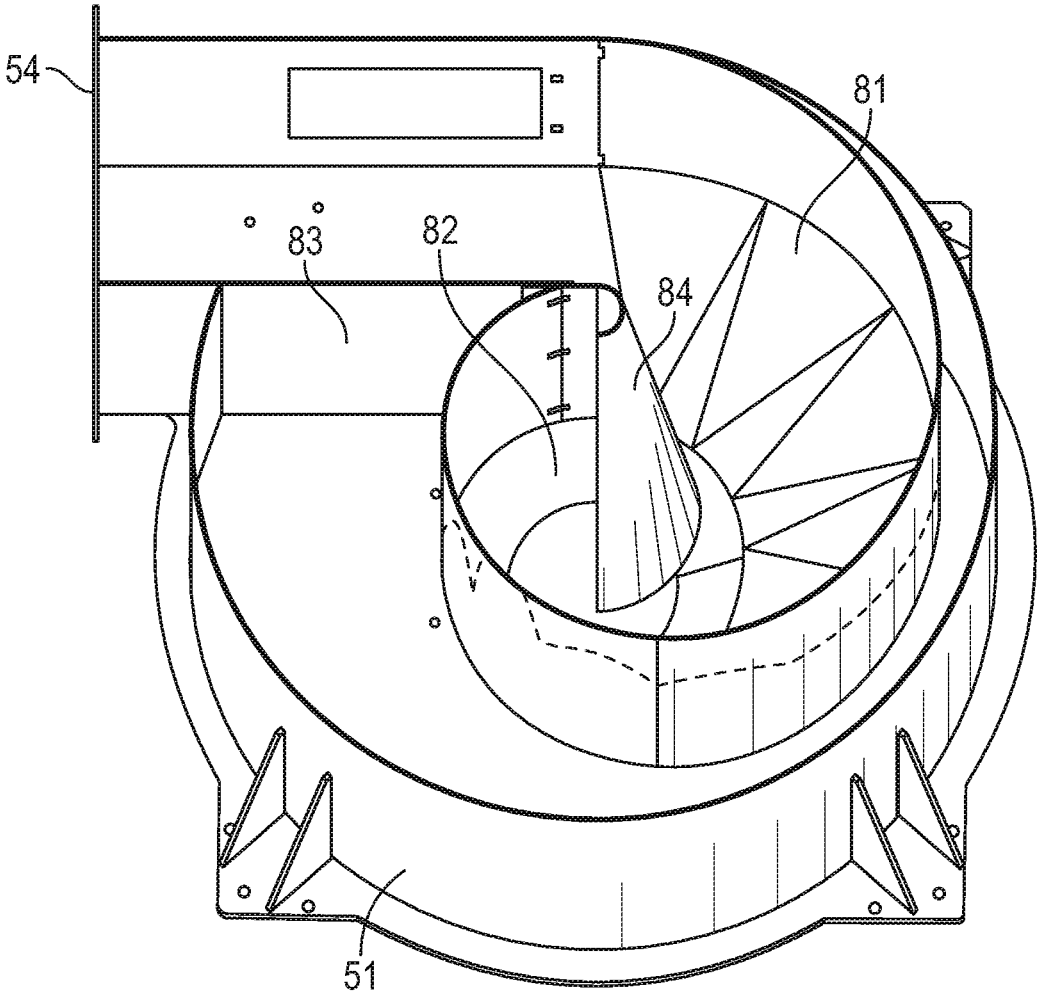
FIG. 15 is a perspective sectional view of a third exemplary embodiment of an inlet section of the dryer shown in FIG. 11.
Figure 17:
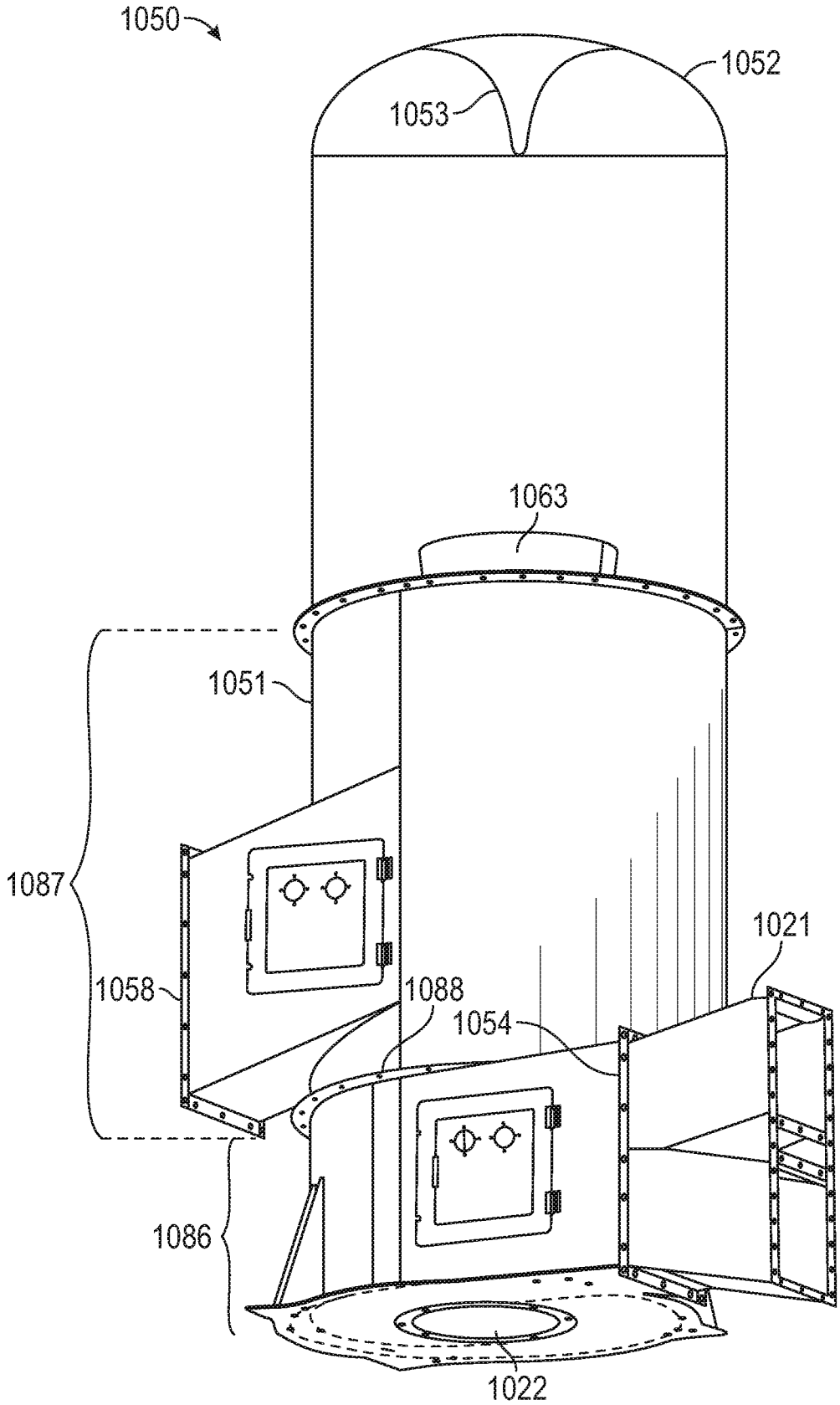
FIG. 17 is a perspective view of a first exemplary embodiment of a vortex tube blender and conditioner of the present invention.
Figure 18:
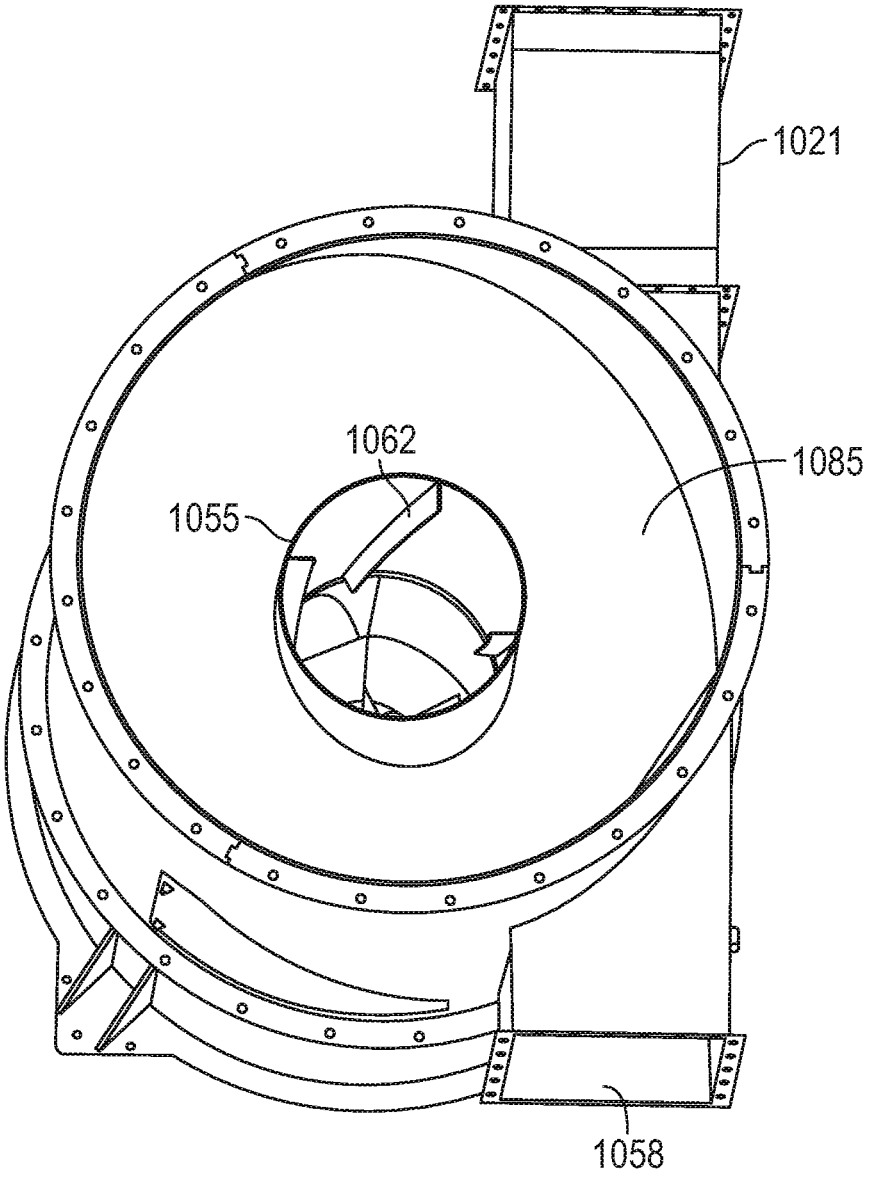
FIG. 18 is a perspective sectional view of the embodiment shown in FIG. 17.

Next, as shown in FIG. 17, an exemplary embodiment of vertical walls of the tangential inlet 1054 are illustrated as defined on the outside by the involute scroll 1080, and on the inside by a vertical wall 1083 that ends near the point where the plane defined by this inside wall meets at or near the tangent point 1089 of the downward imaginary cylindrical projection of the wall of the vortex tube immediately above. This inner wall 1083 may abruptly stop at this tangent point 1089. This is best seen in FIG. 15; wherein, the features 51, 54, 81, 83, and 89 are equivalent to the features 1051, 1054, 1081, 1083, and 1089, respectively.

Figure 19:
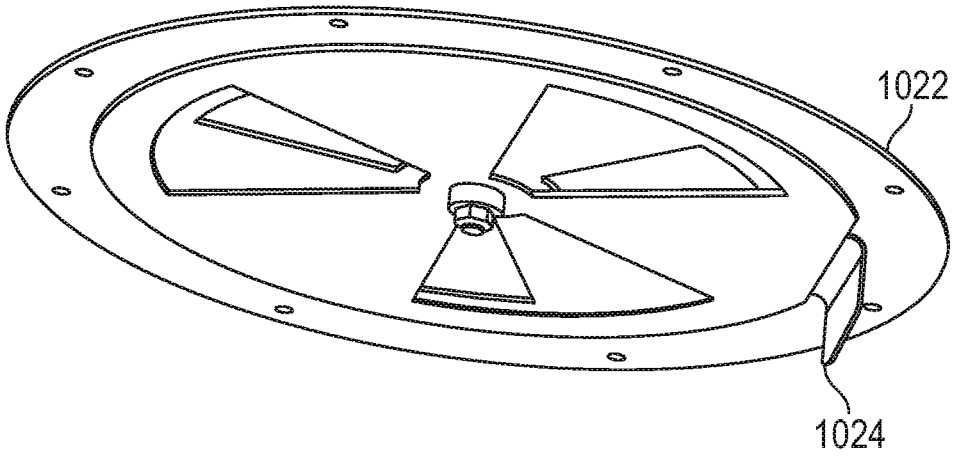
FIG. 19 is a perspective view of the round access door of the embodiment shown in FIG. 17 fitted with an adjustable vent.

In particular, the lower end of the upward ramping floor 1081 surrounds a hole in the floor where a solid access door 1022 for maintenance may be installed. Alternatively, the access door 1022 may be fitted with an adjustable vent 1024 as is shown in FIG. 19 to allow the introduction of ambient air to encourage material that might collect in the middle of the floor to follow the upward air stream when the device is used in a negative pressure conveyance system (a non-limiting illustration can be seen in FIG. 17). The upward ramping floor 1081 may be made in segments, or formed as a smooth continuous surface. Alternatively, the upward ramping floor 1081 may be removed altogether or altered to create more turbulence if a greater blending action is desired.

Further, as shown in FIG. 17, the outlet section 1087 is formed with the floor of the outlet being defined by a single or compound diagonal plane whose lower end terminates immediately prior to the rectangular outlet 1058, with this plane forming a singular canted disc 1085 (see FIG. 12) whose center is removed in such a way as to allow the cylindrical path of the vortex tube 1055 to pass through this plane, and sealed both to the vortex tube and the inner walls of the cylindrical body 1051 in order to maintain air pressure isolation between the inlet and outlet of the device. Some of these features are best seen in FIG. 12, wherein the features 51, 55, 58, 63, 85, 86, 87, and 88 are equivalent to the features 1051, 1055, 1058, 1063, 1085, 1086, 1087, and 1088, respectively.

Next, the velocity of the air and seed cotton entering the vortex tube 1055 increases due to the decrease in cross sectional area. Note that the air entering the vortex tube blender and conditioner 1050 can be ambient air, and does not need to be heated, as in preferred embodiments of the priority vortex tube dryer 50. An exemplary embodiment of the inside of the vortex tube 1055 may be seen in FIG. 18. The vortex tube 1055 contains a set of fixed spinner vanes 1062 which will encourage the continued spiral path of the air and seed cotton. Above the vortex tube 1055 is a diffuser nozzle 1063 (see FIG. 17) designed to reduce the pressure drop as the hot air and seed cotton enter the relatively larger cross section created by the cylindrical body 1051. As the rising column of seed cotton reaches the splitter cone 1053 and dished head 1052 it will spread around the perimeter wall of the cylindrical body 1051 prior to falling back down onto the floor and leaving through the outlet 1058. Optionally, a series of spinner vanes 1075 may be affixed to the surface of the splitter cone 1053 and arranged in a spiral pattern (see FIG. 9), thus encouraging the seed cotton to continue in spiraling path as it reaches the dished head 1052.

Figure 20:
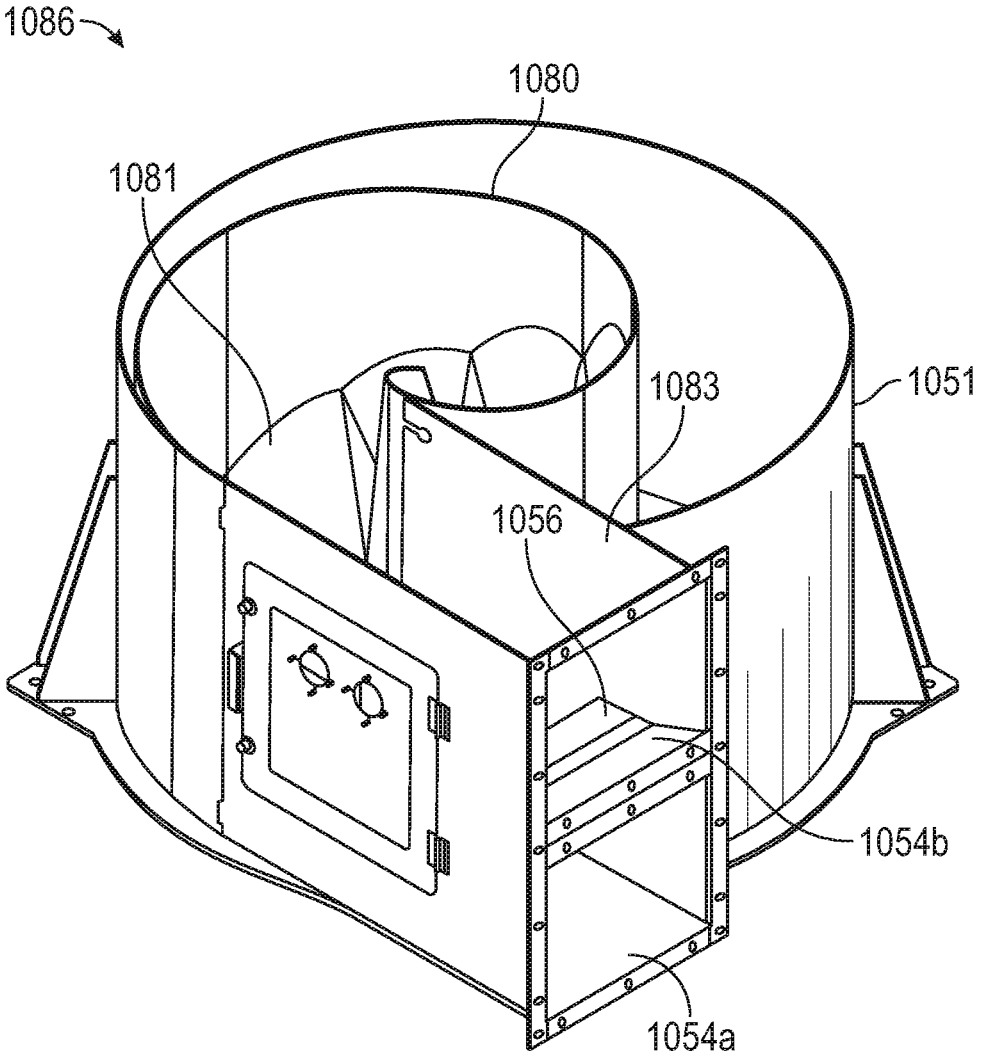
FIG. 20 is a perspective sectional view of an exemplary embodiment of an inlet section of a second exemplary embodiment of a vortex tube blender and conditioner of the present invention.

A second exemplary embodiment of a vortex tube blender 1050 is shown in FIG. 20. The inlet section 1086 has two or more distinct openings 1054*a*, 1054*b* incorporated into the tangential inlet 1054. In one iteration, the additive cross-sectional area of all the tangential inlets (1054*a*, 1054*b*, etc.) is equal to the cross-sectional area of the outlet 1058 in the outlet section 1087 (see FIG. 17). Each tangential inlet (1054*a*, 1054*b*, etc.) allows multiple separate streams, from differing lots, to enter without mixing of the streams, prior to introduction into the present invention. An optional divider panel 1056 separates each stream within the tangential inlet 1054 and may terminate prior to the point where the inlet path passes into the cylindrical body 51. Alternatively, the divider panel 1056 may extend into an area within the diameter of the cylindrical body 1051.

Figure 21:
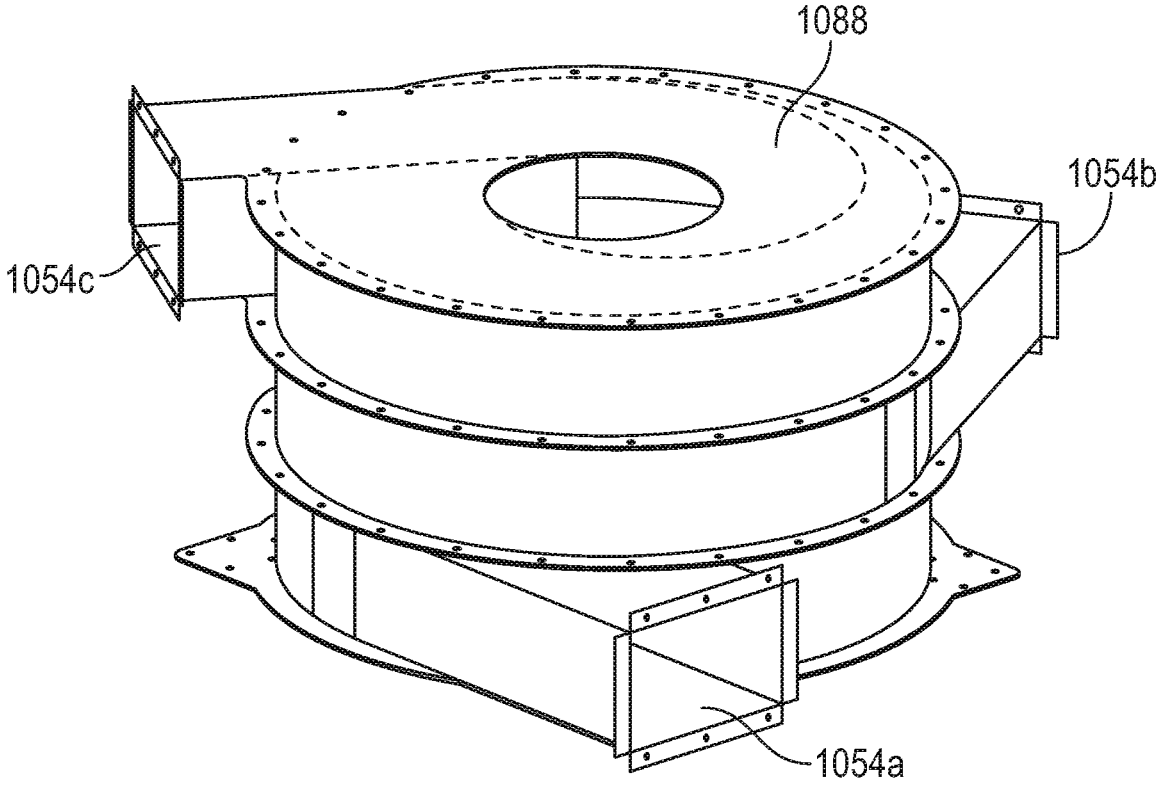
FIG. 21 is a perspective view of a third exemplary embodiment of a vortex tube blender and conditioner of the present invention.
Figure 22:
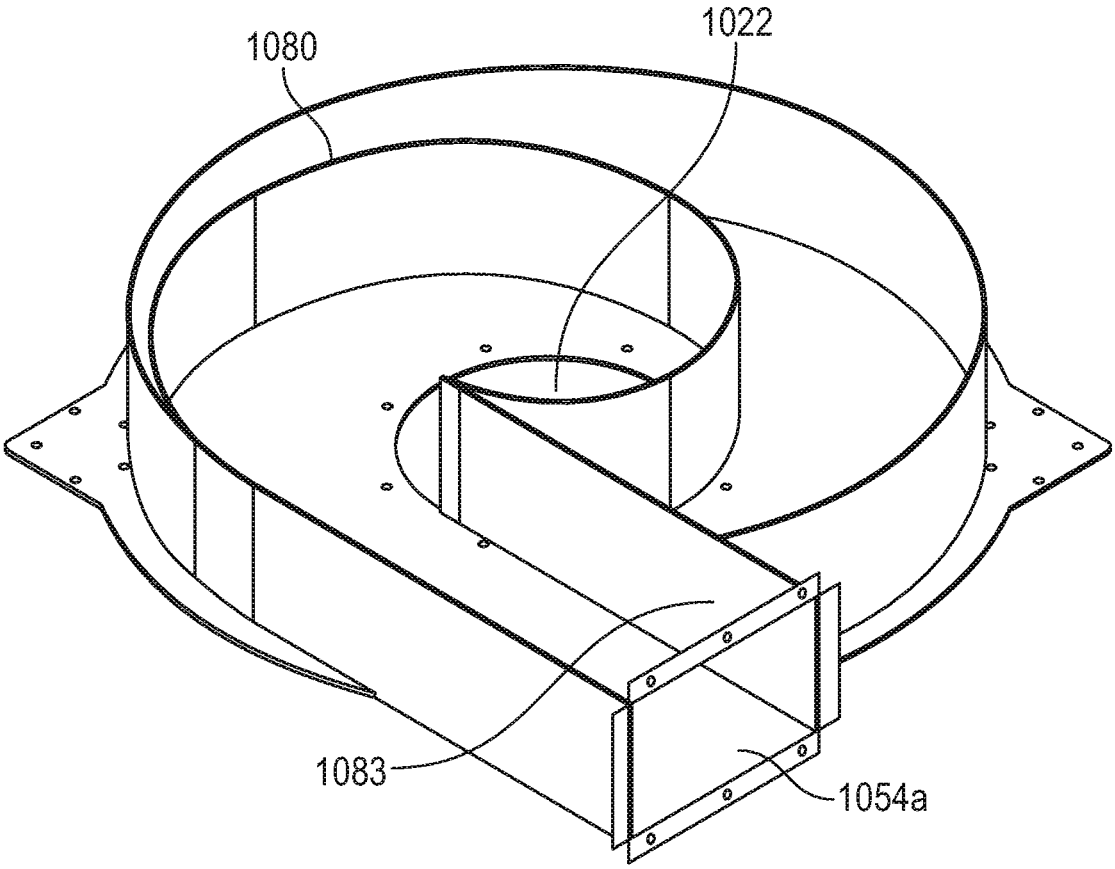
FIG. 22 is a perspective sectional view of an exemplary embodiment of an inlet section of the embodiment shown in FIG. 21.

A third exemplary embodiment of a vortex tube blender 1050 is shown in FIGS. 21 and 22. In this exemplary embodiment, the multiple inlet sections (similar to the first exemplary embodiment of the vortex tube blender 1050 of FIG. 17) may be stacked on top of one another and creating inlet layers. These layers may either be in alignment with one another, or alternatively rotated in some fashion around the central axis as seen in FIG. 21. Further, the additive cross-sectional area of all the tangential inlets (1054*a*, 1054*b*, etc.) is equal to the cross-sectional area of the outlet 1058 in the outlet section 1087.

Figure 23:
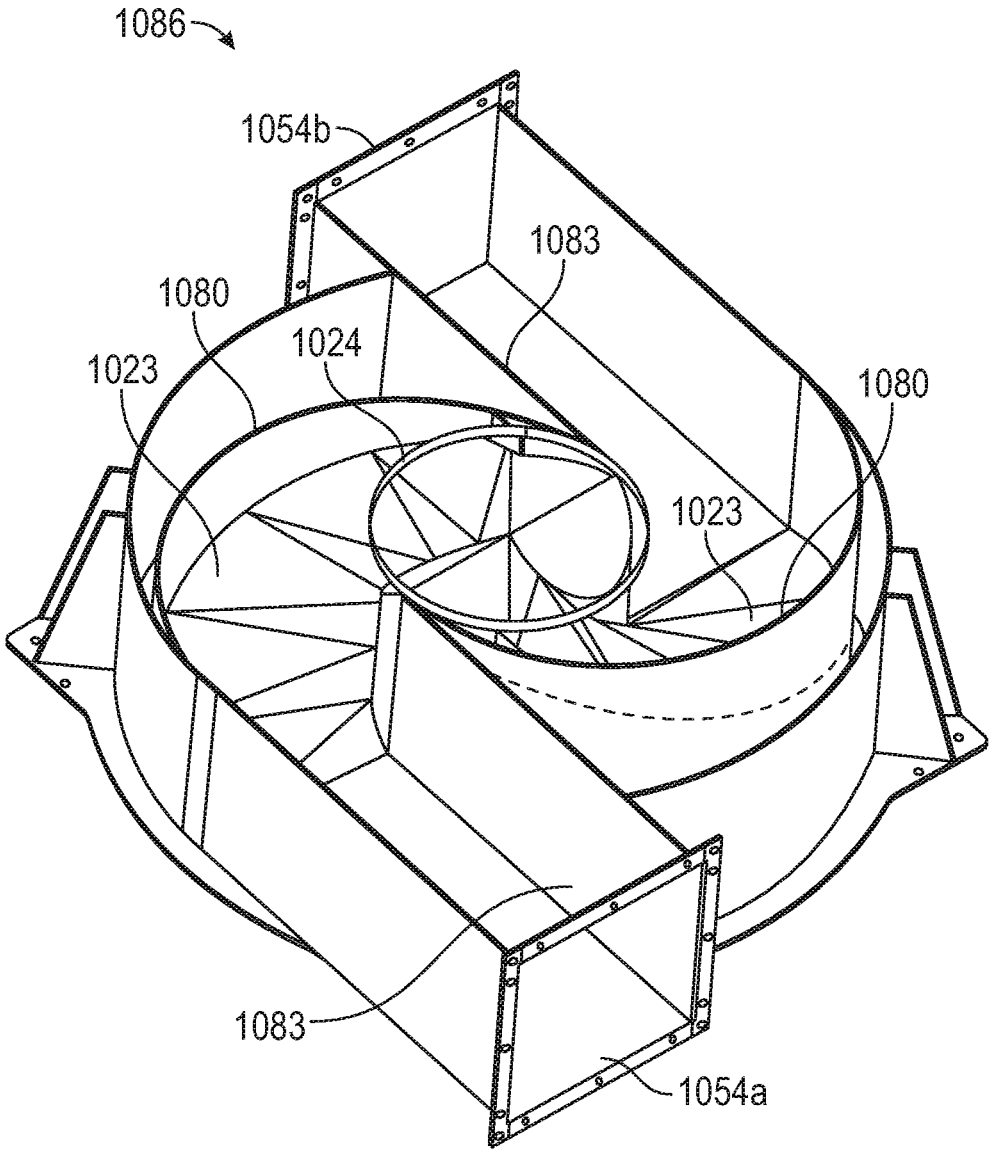
FIG. 23 is a perspective view of a fourth exemplary embodiment of a vortex tube blender and conditioner of the present invention.
Figure 24:
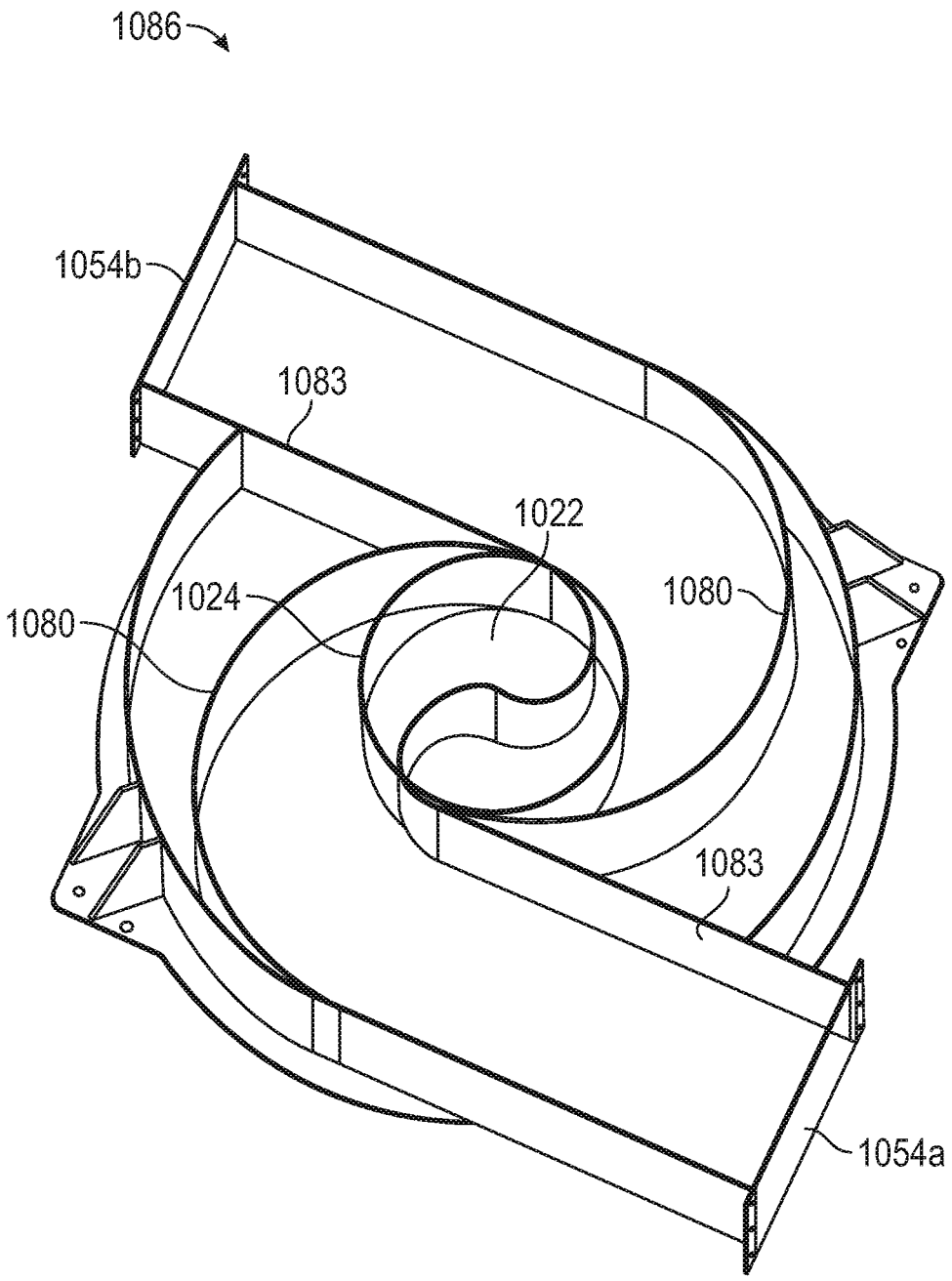
FIG. 24 is a perspective sectional view of an exemplary embodiment of an inlet section of the embodiment shown in FIG. 23.
Figure 25:
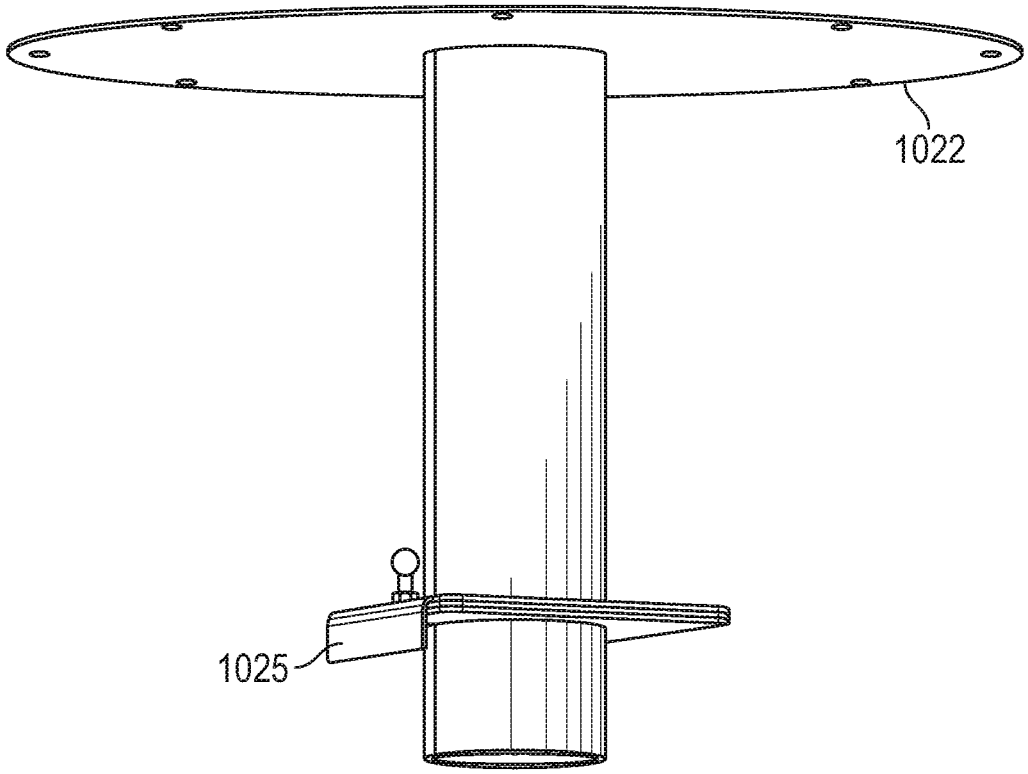
FIG. 25 is a perspective view of the round access door of the embodiment shown in FIG. 17 fitted with a slide gate.

A fourth exemplary embodiment of a vortex tube blender 1050 is shown in FIGS. 23 and 24 where multiple inlet sections enter at differing radial positions (shown here along the same elevation), whose inlet paths converge at a point beneath the vortex tube 1055. The vertical walls of the tangential inlet 1054 are defined on the outside by the involute scroll 1080, and on the inside by a vertical wall 1083. The upward ramping floor 1023 of each inlet together with the narrowing walls serve to reduce the cross-sectional area of the pathway to spin and accelerate conveying air and seed cotton entering the transition ring 1024 at the bottom of the vortex tube 1055. Again, the additive cross-sectional area of all the inlets (1054*a*, 1054*b*, etc.) is equal to the cross-sectional area of the outlet 1058 in the outlet section 1087. The upward ramping floor 1023 may be made in segments, or formed as a smooth continuous surface.

Alternatively, the upward ramping floor 1023 may be removed altogether as seen in FIG. 24, or otherwise altered to create more turbulence if a greater blending action is desired. The inlet 1054 of the system also may be coincidental with the inlet point of the vortex tube 1055. Further, the rectangular outlet 1058 may be formed on the bottom by the spiral exit ramp floor 1064, on the outside by the wall of the cylindrical body 1051, and on the inside wall by the vortex tube 1055.

Alternatively, for this fourth exemplary embodiment, the outlet section 1087 may be formed with the floor 1064 of the outlet 1058 being defined by a single or compound diagonal plane whose lower end terminates immediately prior to the tangential outlet 1058, with the plane forming a singular canted disc 1085 whose center is removed in such a way as to allow the cylindrical path of the vortex tube 1055 to pass through the plane as shown in FIG. 12.

Alternatively, in the first four exemplary embodiments of the vortex tube blender and conditioner 1050, the outlet section 1087 may be replaced by rectangular outlet 1058 and formed as shown in FIG. 7 with a spiral exit ramp floor 1064. The rectangular outlet 1058 also may be formed on the bottom by the spiral exit ramp floor 1064, on the outside by the wall of the cylindrical body 1051, and on the inside wall by the vortex tube 1055. Further, an access door 1022 may be fitted with and adjustable air vent 1024 as is shown in FIG. 19 to allow the introduction of ambient air and to encourage material that might collect in the middle of the floor to follow the upward air stream, which may be more probable when the device is used in a negative pressure conveyance system. This same adjustable vent 1024 may be incorporated into each exemplary embodiment, except for the fourth exemplary embodiment of the vortex tube blender and conditioner 1050 as shown in FIG. 23. However, the alternative arrangement for the fourth exemplary embodiment as shown in FIG. 24 does not have the upward ramping floor 1023 from FIG. 23, thereby allowing the access door 1022 to be employed.

In all cases where it is desirable for the access door 1022 to be fitted with an adjustable air vent 1024, an alternative to ambient air may be from a hot air source instead. This supplemental hot air stream may originate back at an exemplary burner(s) where the heat is introduced to the material air stream, or it may come from an independent heat source, or it may come from a diverted portion of the material conveying air stream prior to the inlet 1054 of the present invention. In some exemplary embodiments, where this supplemental air may be required, it would be preferable to use hot air instead of ambient air as ambient air would presumably be lower in temperature and reduce the thermal efficiency in this stage of the drying and conditioning process. In such a case, the access door 1022 may be constructed with ductwork and a slide gate 1025 (see FIG. 25).

Figure 2:
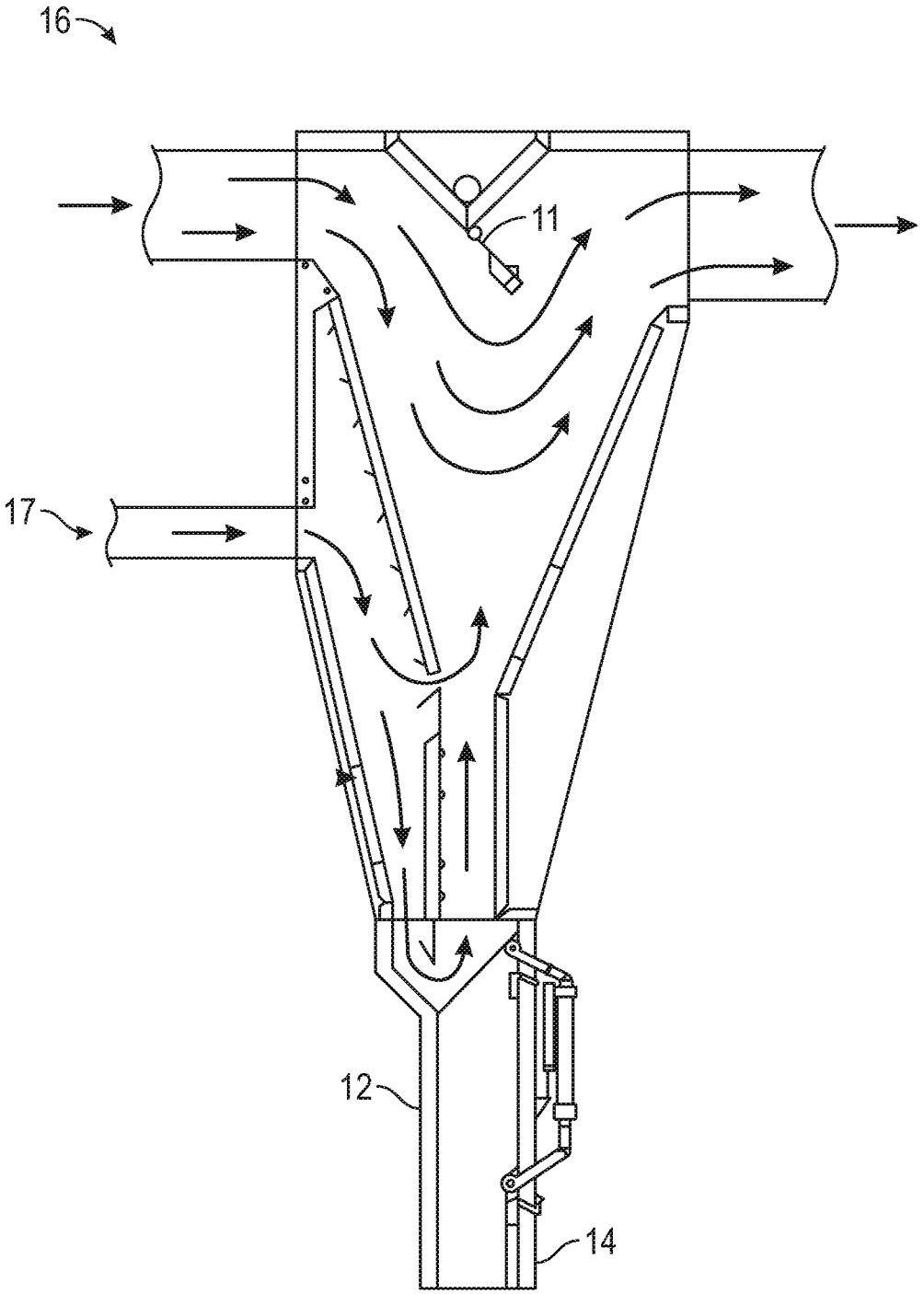
FIG. 2 (Prior Art)
FIG. 2 is a side cross section view of another exemplary embodiment of a prior art hopper-type rock and green boll trap.
Figure 3:
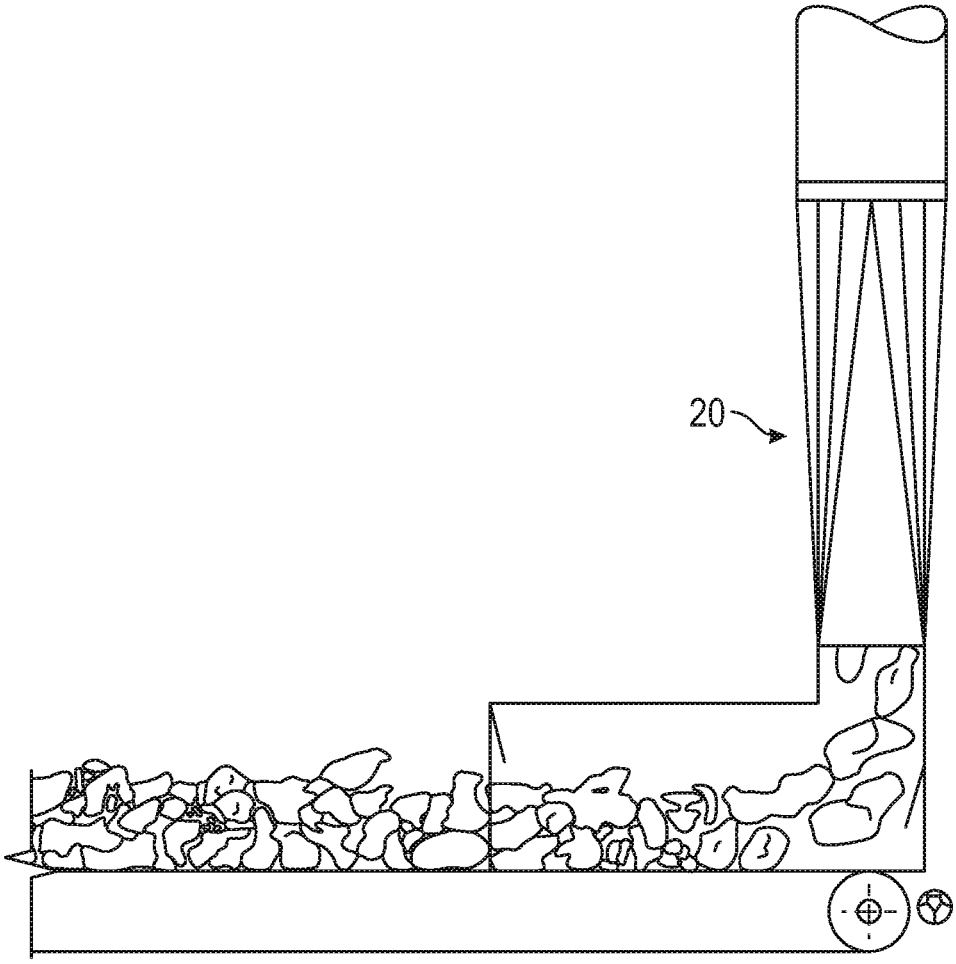
FIG. 3 (Prior Art)
FIG. 3 is a side cross section view of an exemplary embodiment of a prior art conveyor-belt suction-duct-type rock and green boll trap, and is taken from the USDA Cotton Ginners Handbook, December 1994, page 57.
Figure 4:
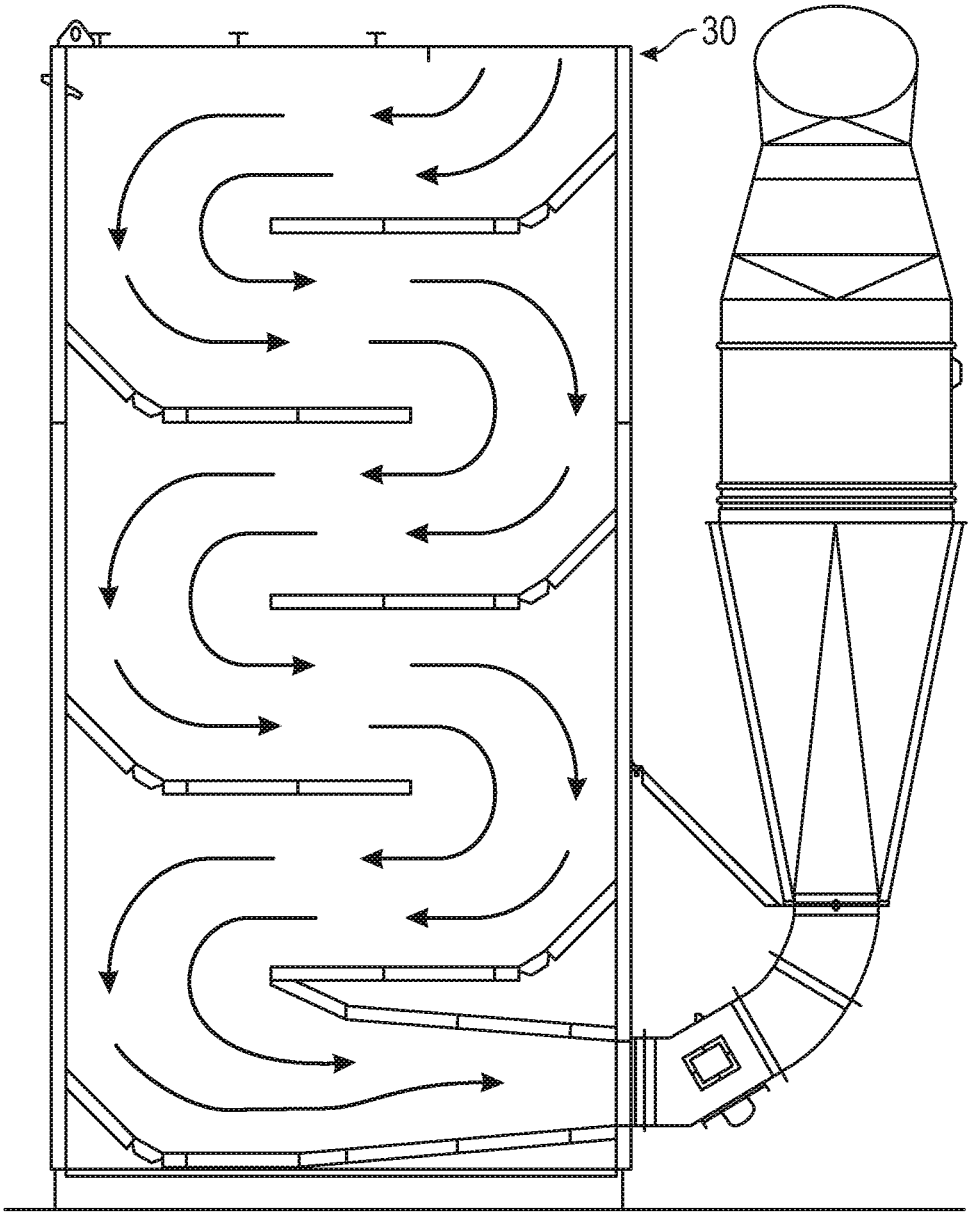
FIG. 4 (Prior Art)
FIG. 4 is a side cross section view of an exemplary embodiment of a prior art shelf-type tower dryer.
Figure 5:
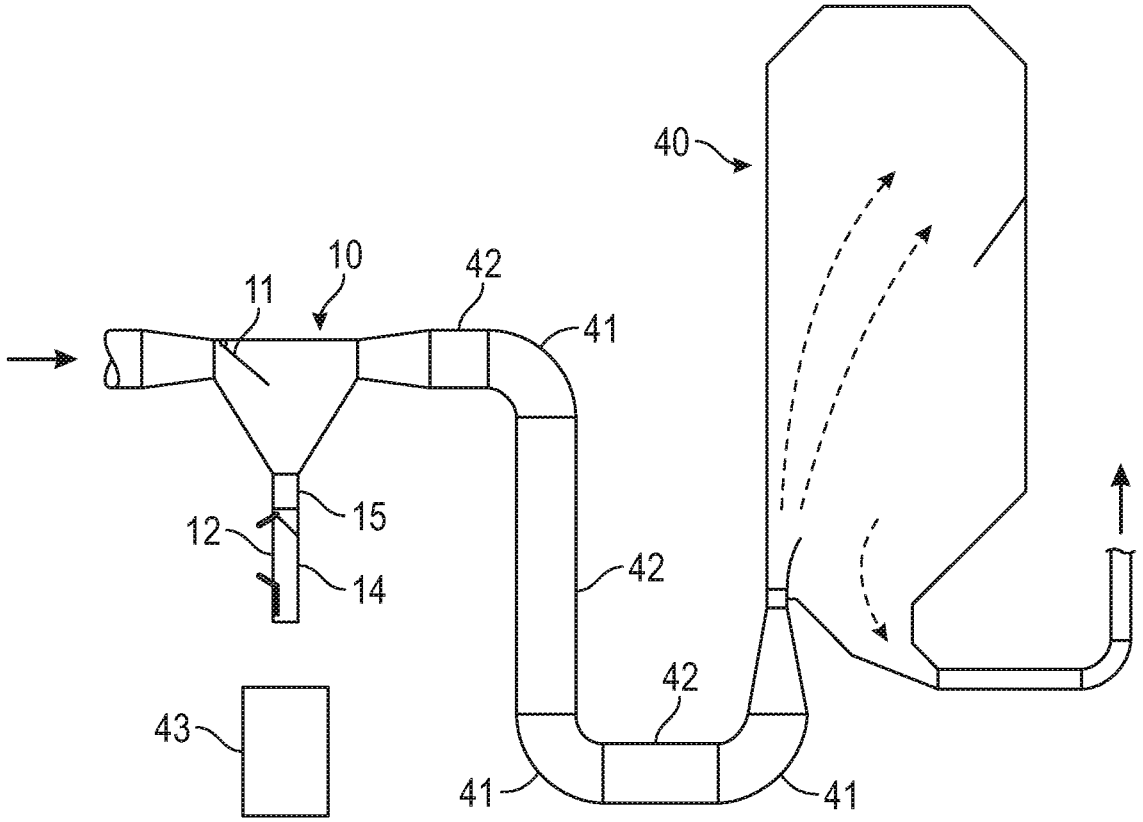
FIG. 5 (Prior Art)
FIG. 5 is a side cross section view of an exemplary embodiment of a prior art hopper-type rock trap followed by an exemplary embodiment of a prior art traditional open-cavity dryer.
Figure 26:
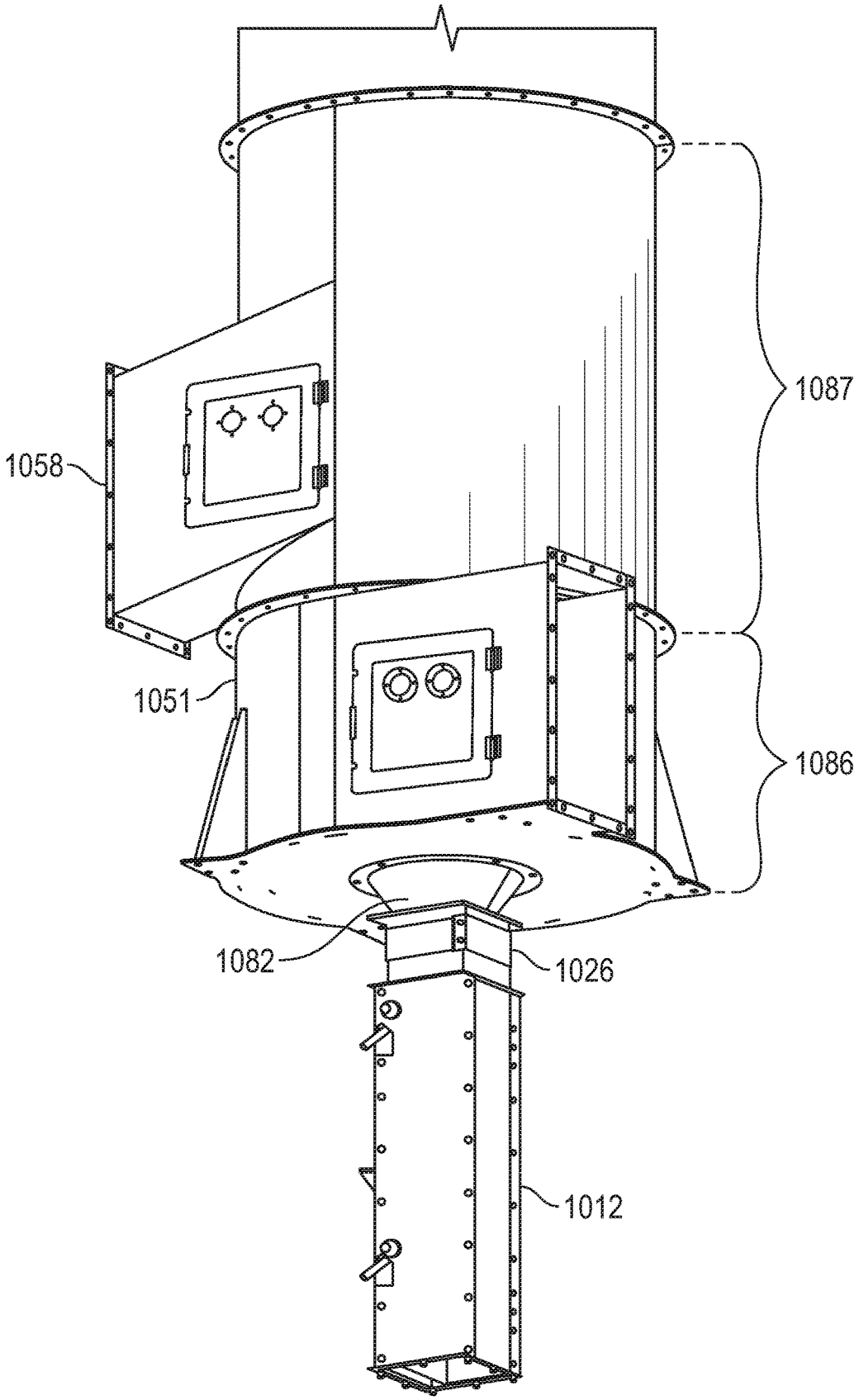
FIG. 26 is a perspective view of the embodiment shown in FIG. 17 altered to remove the access door and modified to install a cone, amongst other additional features.

Turning to FIG. 26, the first exemplary embodiment of the vortex tube blender and conditioner 1050 of FIG. 17 may be altered in such a way as to remove the access door 1022 and instead install a cone 1082. While the seed cotton is carried immediately upward into the accelerating air stream entering the vortex tube 1055 as described in the first exemplary embodiment of the vortex tube blender and conditioner 1050, the relatively heavier items like rocks or green bolls tend to follow the outer wall of the involute scroll 1080, in an ever-tightening path toward the center, where it will tend to reduce in velocity, drop out of the conveying air stream, fall into the cone 1082 attached to the floor at the bottom of the cylindrical body 1051, drop into air lock 1012 (also seen in FIGS. 1, 2, and 6) directly attached beneath the cone 1082, and exit the system.

Figure 27:
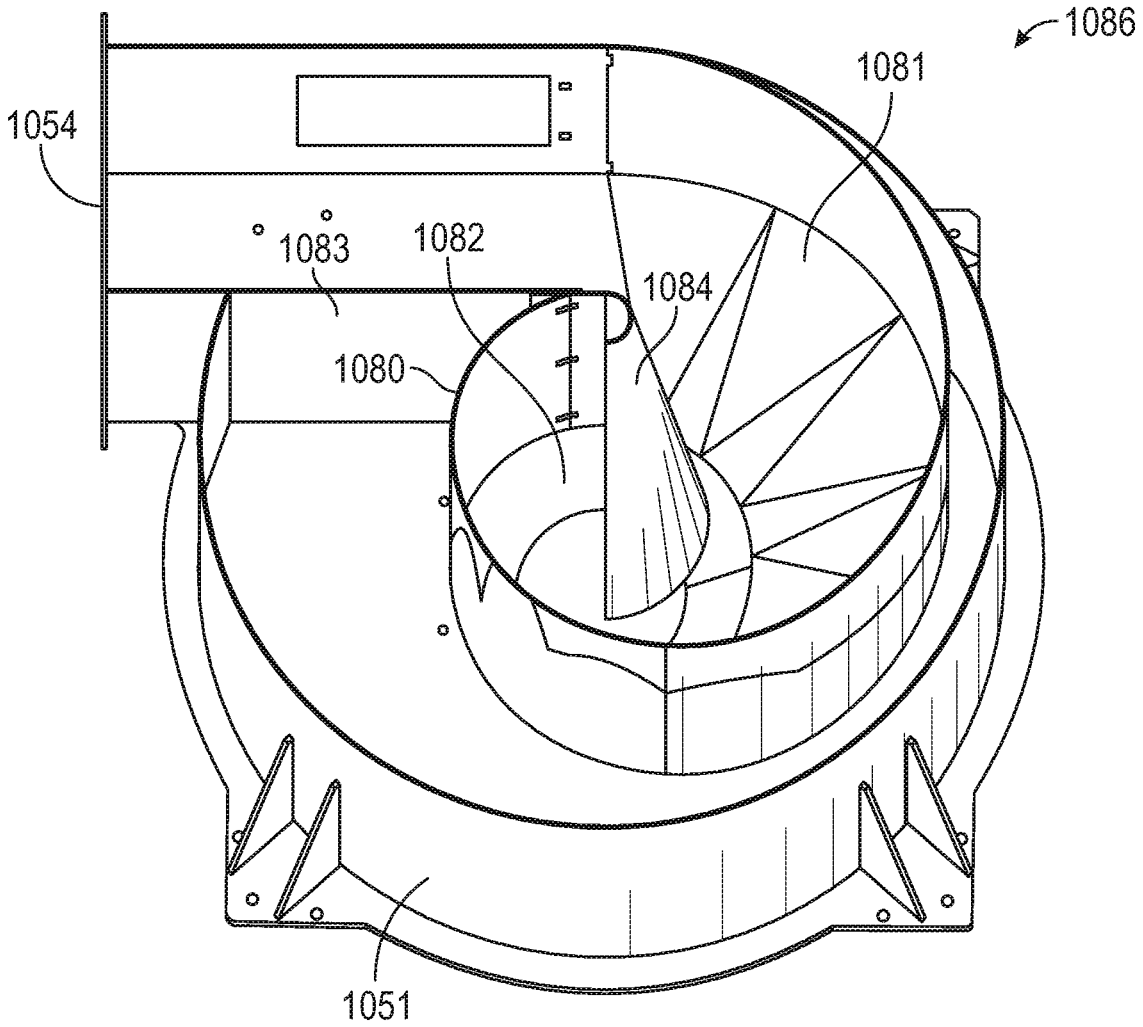
FIG. 27 is a perspective sectional view of an exemplary embodiment of an inlet section of the embodiment shown in FIG. 26.

Further, the first exemplary embodiment of the vortex tube blender and conditioner 1050 of FIG. 17 also may be altered such that the tangential inlet are defined on the outside by the involute scroll 1080, and on the inside by a vertical wall 1083 that ends near the point where the plane defined by this inside wall meets at or near the tangent point 1089 of the downward imaginary cylindrical projection of the wall of the vortex tube 1055 immediately above. This inner wall 1083 may stop abruptly at this tangent point 1089 or may be fitted with a variety of scroll extensions as shown in FIG. 27, so shaped to prevent the separated matter (like rocks and green bolls) from being reintroduced into the air stream entering the vortex tube 1055. One such scroll extension may be described as a portion of a cylinder or as the continuation of the ever-tightening involute scroll 1080. Another shape may be described as a portion of a cone whose defining axis runs parallel or nearly parallel with the vortex tube 1055. A cone version of this scroll extension 1084 may be designed pointing up or down. Portions of the above described scroll extensions may be cut away or extended as required to obtain the desired results described herein.

An adjustable ambient air vent 1026 may be added between the cone 1082 and the air lock 1012 as seen in FIG. 19 if introduction of air to encourage material that might collect in the middle of the floor to follow the upward air stream when the device is used in a negative pressure conveyance system is required. As described previously, the thermal efficiency of the affected stage of drying and conditioning can be increased by pulling hot air in at this point instead of the presumably lower temperature ambient air.

It is envisioned that the cylindrical body 1051 in any of the exemplary embodiments described herein may be made up of a multi-faceted wall with as few as four facets instead of having a smooth, curving surface wall and some components may also be faceted in a similar manner and still maintain the spirit thereof.

Further, it is envisioned that the head 1052 may be dished, spherical, elliptical, conical, or flat and still maintain the spirit thereof.

The various embodiments are provided by way of example and are not intended to limit the scope of the disclosure. The described embodiments comprise different features, not all of which are required in all embodiments of the disclosure. Some embodiments of the present disclosure utilize only some of the features or possible combinations of the features. Variations of embodiments of the present disclosure that are described, and embodiments of the present disclosure comprising different combinations of features as noted in the described embodiments, will occur to persons with ordinary skill in the art. It will be appreciated by persons with ordinary skill in the art that the present disclosure is not limited by what has been particularly shown and described herein above. Rather the scope of the invention is defined by the appended claims.

What is claimed is:

1. A vortex tube system for conditioning a first lot of fiber comprising a first fiber type for entering the system in a fluidly conveyed stream, and for accomplishing a blending of the first lot as it is fluidly conveyed, the vortex tube system comprising a tubular housing, the tubular housing comprising:

a vertical central tube defining an interior between a top end and a bottom end;

a spiraling inlet housing in fluid communication with the bottom end of the vertical central tube, the vertical central tube being partially circumscribed by the spiraling inlet housing;

at least two inlet transition sections, the spiraling inlet housing being accessible via the at least two inlet transition sections, and at least one of the at least two inlet transition sections configured to introduce fibers from the first lot into the spiraling inlet housing, without initiating a blending of the first lot until the fibers from the first lot enter the vortex tube system;

a plurality of fixed helical vanes situated about the interior of the vertical central tube, wherein the plurality of fixed helical vanes homogenizes the fibers from the first lot in the fluidly conveyed stream; and a head forming a diverter dish for directing the fibers from the first lot in the fluidly conveyed stream to a tangential fiber discharge outlet, and for further homogenizing the fibers from the first lot in the fluidly conveyed stream.

2. The vortex tube system as claimed in claim 1, further comprising a lower separating chamber and an upper drying chamber, wherein the vertical central tube defines an air passage from the lower separating chamber to the upper drying chamber.

3. The vortex tube system as claimed in claim 1, wherein the spiraling inlet housing is comprised of:

an inner wall defining the vertical central tube;

an inner wall of the tubular housing;

an outer wall of a lower separating chamber of the vortex tube system;

a downwardly spiraling lower wall;

a connecting wall extending tangentially from the vertical central tube, the connecting wall located between the vertical central tube and the outer wall; and a downwardly spiraling partition spaced above the downwardly spiraling lower wall, the downwardly spiraling lower wall separating the tubular housing into an upper drying chamber of the vortex tube system and the lower separating chamber.

4. The vortex tube system as claimed in claim 1, wherein the spiraling inlet housing is defined by:

an involute scroll positioned subjacent the vertical central tube and diminishing in radius towards the vertical central tube, the involute scroll being affixed to a bottom wall having a radially upward inclination increasing as the involute scroll radius diminishes; and a vertical wall spaced from the involute scroll and extending tangentially from a point immediately below a wall of the vertical central tube to a wall of the tubular housing.

5. The vortex tube system as claimed in claim 4, wherein the tubular housing defines a drying chamber that includes a floor inclined relative to the vertical central tube upwardly from the tangential fiber discharge outlet.

6. The vortex tube system as claimed in claim 1, wherein the vortex tube system operates without, or essentially without, a need for introducing reclaiming air.

7. A vortex tube system for blending a first fiber with a second fiber in a fluidly conveyed stream, the vortex tube system comprising a tubular housing, the tubular housing comprising:

a spiraling intake guide;

a lower separating chamber comprising at least two inlet transition sections, wherein each of the at least two inlet transition sections provide access to the lower separating chamber, and wherein each of the at least two inlet transition sections are configured to tangentially introduce at least a first fiber and at least a second fiber, respectively, into the spiraling intake guide, entrained in an airstream, without a mixing of the at least a first fiber and the at least a second fiber until the at least a first fiber and the at least a second fiber are introduced into the system;

an upper drying chamber comprising an upper deflector head and a fiber discharge outlet;

a central vertical tube defining an air passage from the lower separating chamber to the upper drying chamber, the central vertical tube comprising a plurality of fixed vanes extending inwardly; and an access port for selectively introducing air into the lower separating chamber to promote airflow upwardly alongside the airstream, wherein the spiraling intake guide delivers the at least a first fiber and the at least a second fiber entrained in the airstream to the central vertical tube, wherein the plurality of fixed vanes promote homogenization of the at least a first fiber and the at least a second fiber entrained in the airstream, wherein the upper deflector head is positioned above the central vertical tube, and the fiber discharge outlet is positioned below the deflector head.

8. The vortex tube system as claimed in claim 7, further comprising a spiraling inlet housing in fluid communication with a bottom end of the vertical central tube, wherein the spiraling inlet housing is comprised of:

an inner wall defining the vertical central tube;

an inner wall of the tubular housing;

an outer wall of the lower separating chamber;

a downwardly spiraling lower wall;

a connecting wall extending tangentially from the vertical central tube, the connecting wall located between the vertical central tube and the outer wall; and a downwardly spiraling partition spaced above the downwardly spiraling lower wall, the downwardly spiraling lower wall separating the tubular housing into the upper drying chamber and the lower separating chamber.

9. The vortex tube system as claimed in claim 8, wherein the downwardly spiraling lower wall extends below the central vertical tube into the lower separating chamber.

10. The vortex tube system as claimed in claim 8, wherein the central vertical tube extends below the downwardly spiraling lower wall into the lower separating chamber.

11. The vortex tube system as claimed in claim 7, wherein the airstream through the central vertical tube to a tangential fiber discharge outlet is directed downwardly toward the tangential fiber discharge outlet.

12. The vortex tube system as claimed in claim 7, wherein the access port communicates with the lower separating chamber and is positioned subjacent the lower separating chamber to remove matter dropped from the airstream.

13. The vortex tube system as claimed in claim 7, wherein the upper deflector head includes a plurality of downwardly extending diverter vanes to direct the airstream from an outlet of the central vertical tube.

14. The vortex tube system as claimed in claim 7, wherein the spiraling intake guide is an involute scroll positioned subjacent the central vertical tube and diminishing in radius towards the central vertical tube, the involute scroll being affixed to a bottom wall having a radially upward inclination increasing as the involute scroll radius diminishes.

15. The vortex tube system as claimed in claim 14, wherein the at least two inlet transition sections form a tangential inlet for the airstream, the tangential inlet being defined by an inner wall of the involute scroll and a vertical wall spaced from the involute scroll and extending to a point immediately below the inner wall of the central vertical tube.

16. The vortex tube system as claimed in claim 15, wherein the vertical wall extends below the central vertical tube as a conic section.

17. The vortex tube system as claimed in claim 14, wherein the lower separating chamber and the upper drying chamber are separated by a downwardly spiraling partition with the central vertical tube passing through the downwardly spiraling partition and sealed to the downwardly spiraling partition.

18. The vortex tube system as claimed in claim 14, wherein the upper drying chamber includes a floor inclined, relative to the central vertical tube, upwardly from the fiber discharge outlet.

19. The vortex tube system as claimed in claim 14, wherein the tangential fiber discharge outlet is formed by (1) an outer wall of the central vertical tube, (2) an outer wall of the upper drying chamber, (3) a floor spiraling downwardly about the central vertical tube, and (4) a connecting wall extending tangentially from an outer wall of the central vertical tube.

20. The vortex tube system as claimed in claim 11, wherein the tangential fiber discharge outlet is comprised of:

an outer wall of the central vertical tube;

an outer wall of the upper drying chamber;

the downwardly spiraling partition forming a floor about the central vertical tube; and a connecting wall extending tangentially from the outer wall of the central vertical tube to the outer wall of the upper drying chamber.

21. The vortex tube system as claimed in claim 1, wherein at least one other of the at least two inlet transition sections is configured to introduce fiber from a second lot of fiber also comprising the first fiber type into the spiraling inlet housing, wherein the at least two inlet transition sections are configured to introduce fibers from the first lot of fiber and from the second lot of fiber into the spiraling inlet housing without a mixing of the fibers, from either the first lot of fiber or the second lot of fiber, until the fibers are introduced into the vortex tube system, and wherein the vortex tube system also is for accomplishing a blending of the first fiber type as it is fluidly conveyed.

22. The vortex tube system as claimed in claim 1, wherein at least one other of the at least two inlet transition sections is configured to introduce fiber of a second fiber type into the spiraling inlet housing, from a second lot of fiber comprising the second fiber type, wherein the at least two inlet transition sections are configured to introduce fibers from the first lot of fiber and from the second lot of fiber into the spiraling inlet housing without a mixing of the fiber types until the fibers are introduced into the vortex tube system, and wherein the vortex tube system also is for accomplishing a blending between the first fiber type and the second fiber type as it is fluidly conveyed.

* * * * *